United States Patent [19]

Ueda et al.

[11] 4,359,616

[45] Nov. 16, 1982

[54] SELF-EXTINGUISHING SWITCH

[75] Inventors: Yoshihiro Ueda; Hiroyuki Sasao; Hajimu Yoshiyasu; Soichiro Okuda, all of Amagasaki, Japan

[73] Assignee: Mitsubishi Denki Kabushiki Kaisha, Tokyo, Japan

[21] Appl. No.: 72,048

[22] Filed: Sep. 4, 1979

[30] Foreign Application Priority Data

| | | | |
|---|---|---|---|
| Sep. 4, 1978 | [JP] | Japan | 53-108294 |
| Sep. 4, 1978 | [JP] | Japan | 53-108295 |
| Sep. 4, 1978 | [JP] | Japan | 53-108296 |
| Sep. 4, 1978 | [JP] | Japan | 53-108297 |
| Sep. 4, 1978 | [JP] | Japan | 53-108298 |
| Sep. 4, 1978 | [JP] | Japan | 53-108299 |
| Sep. 4, 1978 | [JP] | Japan | 53-108300 |
| Sep. 4, 1978 | [JP] | Japan | 53-108301 |
| Oct. 17, 1978 | [JP] | Japan | 53-128806 |
| Oct. 17, 1978 | [JP] | Japan | 53-128807 |
| Oct. 17, 1978 | [JP] | Japan | 53-128808 |
| Oct. 17, 1978 | [JP] | Japan | 53-128809 |
| Oct. 17, 1978 | [JP] | Japan | 53-128810 |
| Oct. 17, 1978 | [JP] | Japan | 53-128811 |
| Oct. 17, 1978 | [JP] | Japan | 53-128812 |
| Oct. 17, 1978 | [JP] | Japan | 53-128813 |

[51] Int. Cl.[3] ..... H01H 33/88

[52] U.S. Cl. ..... 200/148 A; 200/148 G

[58] Field of Search ..... 200/148 A, 148 G, 148 R

[56] References Cited

U.S. PATENT DOCUMENTS

| | | | |
|---|---|---|---|
| 2,757,261 | 7/1957 | Lingal et al. | 200/148 G |
| 2,798,922 | 7/1957 | Lingal et al. | 200/148 G |
| 3,786,215 | 1/1974 | Mauthe | 200/148 A |
| 4,139,752 | 2/1979 | Itai et al. | 200/148 A |

FOREIGN PATENT DOCUMENTS

| | | | |
|---|---|---|---|
| 1245530 | 8/1957 | France | 200/148 A |

*Primary Examiner*—Robert S. Macon

*Attorney, Agent, or Firm*—Wenderoth, Lind & Ponack

[57] ABSTRACT

A hollow cylindrical member includes a compression chamber and a reservoir partitioned by a circumferential step disposed on its inner wall surface and filled with an arc-extinguishing fluid. A piston loaded with a spring forms stationary contact and is slidably fitted into the compression chamber while the reservoir is connected to the exterior of the cylindrical member through a flared hole in an electrically insulating nozzle. A movable contact loosely extends through the nozzle to engage separably the piston. The stationary contact may be disposed in the reservoir while the piston serves as an arc contact. The spring may be replaced by a tulip-shaped member on the piston forced into a recess on the free end of the movable contact and leaving it upon the piston engaging the step.

24 Claims, 51 Drawing Figures

SELF-EXTINGUISHING SWITCH

BACKGROUND OF THE INVENTION

This invention relates to a gas-blast switch for interrupting an electric arc struck across a pair of stationary and movable contact members by blowing an arc extinguishing fluid such as sulfurhexafluoride ($SF_6$) against the electric arc, and more particularly to a self-arc-extinguishing type switch utilizing an arc-extinguishing fluid at high pressure on an electric arc struck across a pair of stationary and movable contact members for extinguishing the electric arc.

Among puffer type switches for extinguishing the electric arc struck across the stationary and movable contact members by blowing the arc-extinguishing fluid such as sulfur hexafluoride against the electric arc, here have been known switches of the type including a pair of engageable contact members arranged to be separated from each other within an arc-extinguishing chamber of a predetermined volume to strike an electric arc thereacross and an amount of an arc-extinguishing fluid disposed in the arc-extinguishing chamber to be expanded by the thermal energy of the electric arc thereby to increase in pressure after which the arc-extinguishing fluid from the arc-extinguishing chamber is delivered to the exterior thereof when the spacing between the contact members reaches a predetermined magnitude, whereupon the resulting stream of the arc-extinguishing fluid is caused to interrupt the electric arc.

Switches of the type referred to are called self-extinguishing type switches because the arc-extinguishing operation is performed by utilizing the arc-extinguishing fluid having the pressure increased by the arc energy.Those switches have eliminated the necessity of providing additional means for pressurizing the arc-extinguishing fluid which have been required for conventional puffer type switches so that the resulting structure is simple and economical.

On the other hand, switches of the type referred to sometimes do not satisfactorily pressurize the arc-extinguishing fluid for interrupting low currents because the resulting arc energy is low. In order to avoid this problem, Japanese laid-open patent application No. 25,869/78, for example, discloses a pressurizing piston disposed in an arc-extinguishing chamber to interlock with the operation of separating a pair of contact member from each other thereby to pressurize the arc-extinguishing fluid. The piston is arranged to be moved over the entire volume of the arc-extinguishing chamber to compress the arc-extinguishing fluid. Therefore, when interrupting a high current having high arc energy, the arc-extinguishing fluid is greatly increased in pressure when its temperature rises excessively resulting in the deterioration of the interrupting performance. Also the arc-extinguishing chamber becomes extremely small in volume because of the movement of the piston as described above and therefore a very high fluid pressure is created. This has resulted in the necessity of using high-power operating means for operating the piston as well as the necessity of providing closing means having a high power sufficient to overcome the force generated by the operating means.

If the fluid pressure within the arc-extinguishing chamber overcomes the force for operating the piston then the piston is moved toward its initial inoperative position. This has resulted in a reduction in fluid pressure within the arc-extinguishing chamber and therefore in interrupting performance. With the piston is formed integrally with the stationary contact member, the movable contact member may repeatedly engage with and disengage from the stationary contact member resulting in the occurrence of chattering. Under these circumstances, if electric arcs strike across both contact members then the contact members may be fused to each other.

Accordingly, it is an object of the present invention to provide a new and improved self-extinguishing switch having excellent interrupting performance by increasing the pressure of the arc-extinguishing fluid so that it is suitable for interrupting currents within a wide range of from a low to a high magnitude thereby to exert a puffer action on the electric arc struck across a pair of stationary and movable contact members.

It is another object of the present invention to provide a new and improved self-extinguishing switch capable of interrupting current efficiently even though the current is low.

It is still another object of the present invention to provide a new and improved self-extinguishing type switch having a long time interval during which an arc-extinguishing fluid is blown against the electric arc.

It is a different object of the present invention to provide a self-extinguishing switch having improved interrupting characteristics for high currents while retaining the good interrupting performance for low currents.

It is another object of the present invention to provide a new and improved self-extinguishing type switch capable of reserving a proper amount of arc-extinguishing fluid having increased pressure up to the time of interruption of the electric.

It is another object of the present invention to provide a new and improved self-extinguishing type switch including means for controlling the temperature rise of the arc-extinguishing fluid and maintaining a pressure thereof as high as possible.

It is another object of the present invention to provide a new and improved self-extinguishing type switch for preventing a pair of stationary and movable contact members from being fused to each during the closing operation without any deterioration in interrupting performance.

It is a separate object of the present invention to provide a new and improved self-extinguishing type switch including simplified operating means and having a stablized interrupting performance.

SUMMARY OF THE INVENTION

The present invention provides a self-extinguishing type switch comprising, a hollow cylindrical member, an amount of arc-extinguishing fluid accommodated in the hollow cylindrical member, a pair of contact members disposed in the hollow cylindrical member so as to be relatively movable to engage and disengage from each other, a reservoir disposed in the hollow cylindrical member in which to accumulate the arc-extinguishing fluid having an increased pressure due to an electric arc being struck across the contact members when they are separated from each other, a compression chamber disposed in the hollow cylindrical member and connected in fluid communication with the reservoir, a piston movably disposed in the compression chamber and interlocked with the operation of the contact member from each other to compress the arc-extinguishing fluid in the compression chamber and deliver the compressed fluid to the reservoir, and a nozzle connected in fluid communication with the reservoir, the nozzle delivering the arc-extinguishing fluid located in the reservoir at an increased pressure after the contact members are separated a predetermined distance.

In order to prevent the arc-extinguishing fluid within the reservoir from increasing in both pressure and temperature, at least one of the contact members during their separation or the piston may be provided with an exhaust passageway permitting the reservoir to communicate with the exterior of the hollow cylindrical member therethrough after the separation of the contact members. This measure is effective for exhausting a portion of the arc-extinguishing fluid at an elevated temperature into the exterior of the hollow cylindrical member after the separation of the contact members. Therefore the interrupting characteristics for high currents can be improved while those for low currents are retained.

In order to prevent the arc-extinguishing fluid in the reservoir from abruptly rising in temperature so that the fluid in the reservoir will remain therein until the interruption of the electric arc involved, an encircling member may be disposed in the hollow cylindrical member to encircle the movable contact member at its closed position over a predetermined length measured from a free end thereof.

In order to keep the arc-extinguishing fluid within the reservoir at a temperature as low as possible while maintaining the fluid pressure in the reservoir as high as possible, the exhaust passageway may extend through one of the contact members or the stationary contact member and communicate with at least one pair of radial holes in the stationary contact member and selectively opened and closed in accordance with the distance of movement of the stationary contact member. This permits the reservoir to be selectively connected in fluid communication with the exterior of the hollow cylindrical member.

In order to stabilize the interrupting performance with a simple, inexpensive driving means, the switch may include a resilient member for causing the piston to tend to be forced in the direction of compression of the arc-extinguishing fluid, the resilient member also imparting a separation force to the movable contact member, closing means for moving the movable contact member toward the stationary contact member to engage the latter, and locking means for holding the movable contact member in engagement with the stationary contact member.

The movable contact member may be maintained in engagement with the stationary contact member by coupling means disposed on the free end faces of both contact members, to be held until a trip force of a predetermined magnitude is applied to the coupling means. That trip force is preferably applied to the coupling means when the piston reaches the position where the piston completes the operation of compressing the arc-extinguishing fluid. This measure prevents the piston from being returned to its initial inoperative position with the result that the puffer action is effectively exerted on the electric arc involved to interrupt the particular current rapidly. Further, upon passing a current through the stationary contact member with the piston resiliently held at its initial inoperative position, the stationary contact member is effectively prevented from being moved due to the electromagnetic repulsion applied thereto.

The contact members may include a movable contact member and a stationary contact member fixedly disposed in the hollow cylindrical member. The stationary contact member serves only to carry a current so that the mechanism for operating the contact members can be simplified while the fusion and wear and tear of the contact members is reduced.

If desired, the movable contact member may be maintained in engagement with the piston by coupling means disposed on engaging portions of the two to be held until a trip force of a predetermined magnitude is applied to the coupling means. This measure is effective for preventing the fusion of the contact members without the deterioration of the interrupting performance.

Engaging means may be disposed at a position where the piston completes the compressing operation and abuts the engaging means. This measure is effective for preventing fusion of the contact members upon their closure without the deterioration of interrupting performance.

In order to prevent the piston from being returned to its initial inoperation position and interrupt rapidly the particular current by exerting more effectively the puffer action on the associated electric arc, a back pressure chamber for the piston may be disposed in the compression chamber and be connected in fluid communication with the exterior of the hollow cylindrical member through a communication passageway, and a check valve may be disposed in the communication passageway to permit the arc-extinguishing fluid to flow into the back pressure chamber only from the exterior of the hollow cylindrical member.

BRIEF DESCRIPTION OF THE DRAWINGS

The present invention will become more readily apparent from the following detailed description taken in conjunction with the accompanying drawings in which.

Throughout the Figures like reference numerals designate the identical or corresponding components.

DESCRIPTION OF THE PREFERRED EMBODIMENTS

Figure 1:
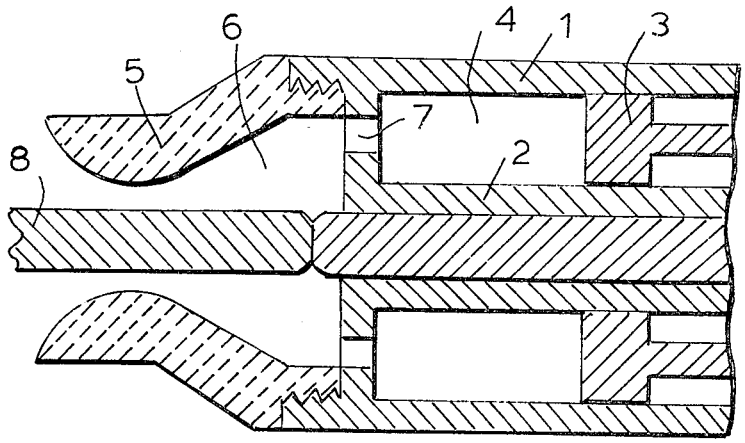
FIG. 1 (PRIOR ART)
FIGS. 1 and 2 are longitudinal sectional views of a conventional puffer type switch illustrated in its closed and tripped positions, respectively, with parts omitted.

Referring now to FIG. 1 of the drawings, there is illustrated a conventional single-pressure puffer type switch. The arrangement illustrated comprises a puffer cylinder 1 operatively coupled to a operating mechanism (not shown), a movable contact member 2 fixedly disposed in an axial portion of the cylinder 1 and an annular puffer piston 3 slidably fitted into the puffer cylinder 1 to form an annular compression chamber 4 with an apertured bottom of the cylinder 1. The piston 3 is fixed at its position illustrated in FIG. 1 by means of a supporting member (not shown). The puffer cylinder 1 has an electrically insulating nozzle 5 screw threaded into the bottom portion thereof to define therein an arc-extinguishing chamber 6 that, in turn, communicates with the compression chamber 4 through a plurality of communicating holes 7 extending through the bottom of the puffer cylinder 1. A stationary contact member 8 is supported on a supporting member (not shown) and includes a free end portion loosely extending through the nozzle 5 with its free end normally contacted by the free end of the movable contact member 5 as shown in FIG. 1.

Figure 2:
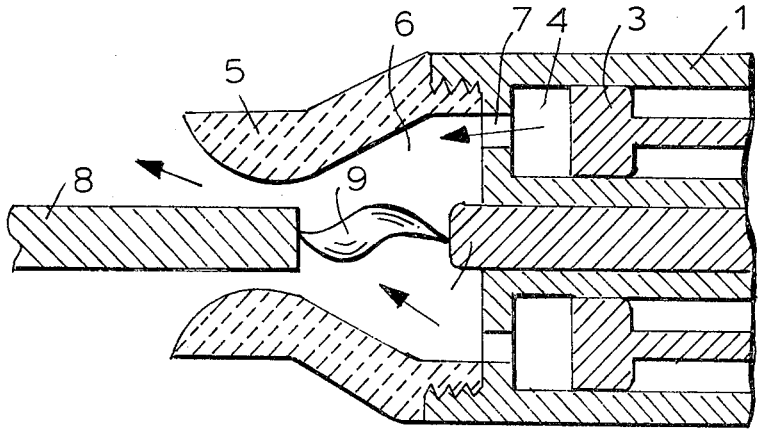
FIG. 2 (PRIOR ART)

When trip command signal is received the operating mechanism (not shown) is operated to move the cylinder 1 and the movable contact member 2 integral therewith in a rightward direction as viewed in FIG. 1 to separate the movable contact member 2 from the stationary contact member 8. At that time an electric arc 9 strikes across both contact members 2 and 8 within the arc-extinguishing chamber 6 as shown in FIG. 2 while simultaneously the piston 3 is relatively moved toward the bottom of the cylinder 1 to compress an amount of an arc-extinguishing fluid such as sulfur hexafluoride ($SF_6$) disposed in the cylinder 1. The fluid compressed to a high pressure blows against the electric arc 6 through the communicating holes 7 as shown by the arrows in FIG. 2 resulting in the rapid extinction of the electric arc 6.

In conventional single-pressure puffer type switches such as shown in FIGS. 1 and 2 the puffer cylinder and the electrically insulating nozzle interlocking with the interrupting operation have been heavy, resulting in the disadvantage that a high-power operating mechanism is required to drive them. This disadvantage has been conspicuous particularly in high capacity switches because the compression chamber such as the chamber 4 needs a large volume and because heat due to the electric arc increases the pressure rise within the compression chamber thereby to increase the force tending to push the piston back with respect to the mating cylinder.

Contrary to switches such as described above, it has been previously proposed to extinguish the electric arc struck upon interrupting of the currents, only by the utilization of the arc-extinguishing fluid expanded by the heat of the electric arc without either the use of means for compressing the fluid to a high pressure or the compression of the fluid by an operating force. This measure has been disadvantageous in that the particular reservoir having accumulated therein the fluid thus expanded rises excessively in temperature which is attended with a reduction in arc-extinguishing performance.

Figure 3:
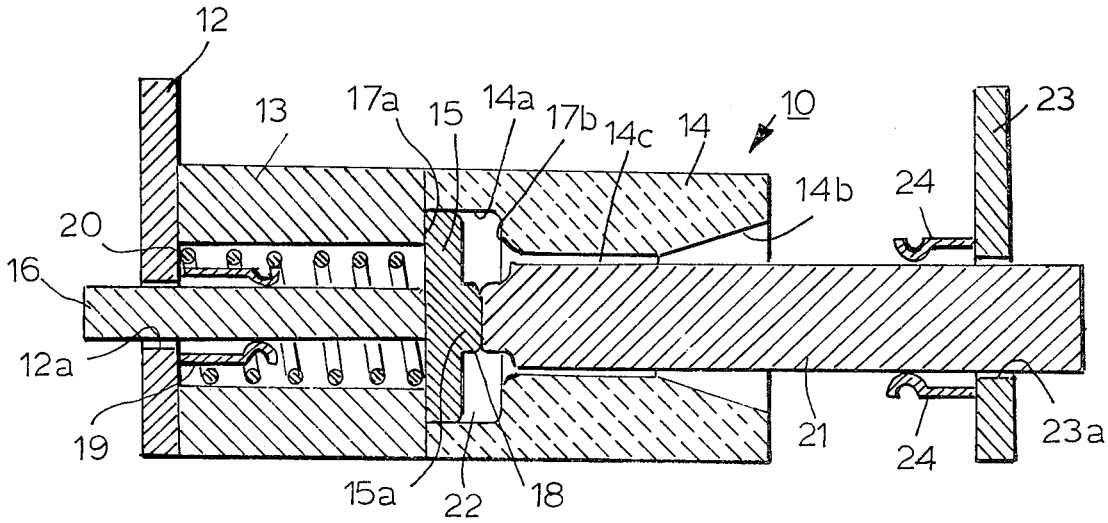
FIG. 3 (PRIOR ART)
FIGS. 3 and 4 are views similar to FIGS. 1 and 2 respectively but illustrating another puffer type switch.

FIG. 3 shows another conventional single-pressure puffer type switch. In the arrangement illustrated in FIG. 3 a puffer cylinder generally designated by the reference numeral 10 includes a terminal plate 12, a hollow cylindrical supporting member 13 fixed at one end to the terminal plate 12 and an electrically insulating member 14 in the form of a hollow cylinder fixed to the other end of the supporting member 13. The puffer cylinder 10 is kept stationary by means of a supporting member (not shown) and the insulating cylindrical member 14 has an internal stepped cylindrical space having a large diameter space portion 14*a* located on that end portion thereof abutting the supporting cylindrical member 13 and has the other end portion 14*b* flared toward its open end and an intermediate cylindrical space 14*c* interconnecting both end portions. A puffer piston 15 is slidably fitted into the large diameter space portion 14*a* of the insulating member 14 and provided on that surface thereof remote from the supporting member 13 with a central raised portion forming a contact 15*b*. That surface of the puffer piston 15 exposed to an internal cylindrical space within the supporting member 13 and which is smaller in diameter than the space portion 14*a* is connected to a guide rod 16 extending through the internal cylindrical space of the supporting member 13 and then slidably extending through a through hole 12*a* in the terminal plate 12. The puffer piston 15, the contact 15*a* and the guide rod 16 form a stationary contact member generally designated by the reference numeral 18.

The large diameter space portion 14*a* includes one end defined by an annular portion of the end surface of the supporting member 13 exposed to the space portion 14*a* and the other end defined by an annular round step 17*b* radially inward extending from the inner wall surface of the large diameter space portion 14*a* and merged into the interface between that space portion 14*a* and the intermediate space portion connected to the flared portion 14*b*.

A collector 19 is mounted on the terminal plate 12 to abut resiliently against the outer peripheral surface of the guide rod 16 and a helical spring 20 is disposed within the internal cylindrical space of the supporting member 13 and between the terminal plate 12 and the puffer piston 15 to encircle the guide rod 16 and the collector 19. The helical spring 20 tends normally to force the puffer piston 15 toward the annular step 17*b*.

A movable contact member 21 is inserted into the internal stepped cylindrical space of the insulating member 4 from the flared end portion 14*b* until its free end abuts the contact 15*a* of the stationary contact member 18. At that time the stationary contact member 18 is maintained at its position illustrated in FIG. 3 against the resilience of the helical spring 20 to hold the puffer piston 15 in engagement with the annular exposed end portion 17*a* of the supporting member 13. Under these circumstances, a compression chamber 22 is formed in the large diameter space portion 14*a* of the insulating member 14 and connected in fluid communication with the exterior of the cylinder 10 through the annular gap formed within portion 14*c* between the inner wall surface of the insulating cylindrical member 14 and the outer peripheral surface of the movable contact member 21.

The movable contact member 21 has the other end portion slidably extending through a through hole 23*a* disposed in another terminal plate 23 and operatively coupled to an operating mechanism (not shown). Also a collector 24 is disposed on the terminal plate 23 so as to abut resiliently against the outer peripheral surface of the movable contact member 21.

The arrangement of FIG. 3 is disposed within an enclosure (not shown) to form therebetween a space filled with an amount of an arc-extinguishing fluid such as gaseous sulfur heaxfluoride ($SF_6$). Therefore the compression chamber is filled with the arc-extinguishing fluid. This space is called hereinafter an "external space" because it is located externally of the cylinder 10. The terminal plates 12 and 23 are suitably fixed to respective stationary members (not shown) disposed in the enclosure (not shown).

Figure 4:
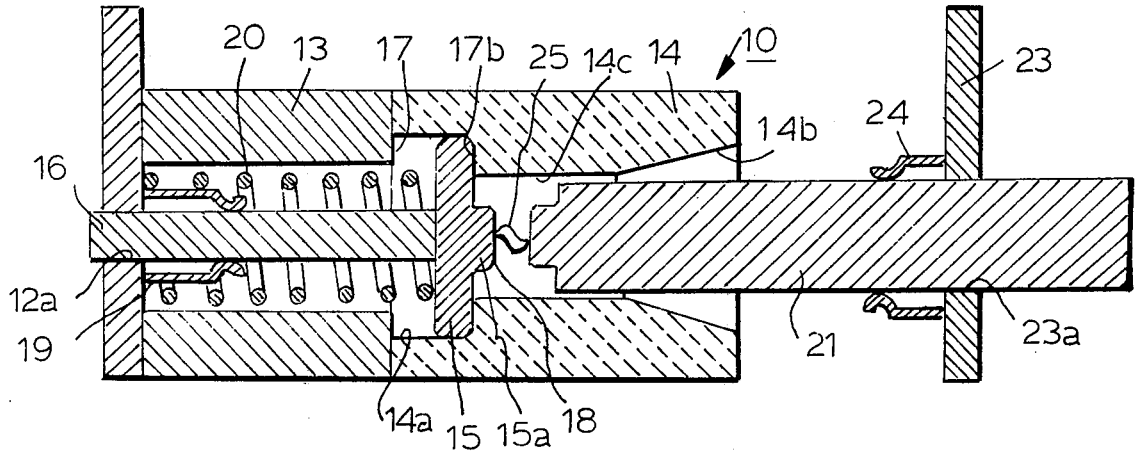
FIG 4 (PRIOR ART)

As in the arrangement shown in FIGS. 1 and 2, the operating mechanism (not shown) is operated to move the movable contact member 21 in the rightward direction as viewed in FIG. 3. Since the stationary contact member 18 tends to be moved in the rightward direction by means of the action of the helical spring 20, the same is moved in that direction with the movable contact member 21 until the puffer piston 15 abuts against the annular step 17*b* as shown in FIG. 4. This prevents a further rightward movement of the piston 15 and therefore the stationary contact member 18. During this movement the puffer piston 15 is effective for compressing the arc-extinguishing fluid within the compression chamber 22.

When the movable contact member 22 is further moved in the rightward direction, the contact members 18 and 21 are separated from each other whereupon an electric arc 25 strikes thereacross within the internal cylindrical space of the insulating member 14 as shown in FIG. 4. Upon the electric arc striking across the separated contact members 18 and 21, the arc-extinguishing fluid exposed to the electric arc 25 is expanded thereby to raise the fluid pressure in the compression chamber 22 rapidly.

After having disengaged from the stationary contact member 18 the movable contact member 21 is relieved of its load due to the contact member 18 and therefore is rapidly spaced from the stationary contact member 18 to spread the electric arc 25 rapidly until the free end of the movable contact member 21 reaches the flared portion 14*a* of the insulating member 14 to widen the spacing formed therebetween. At that time, the arc-extinguishing fluid compressed within the compression chamber 22 is permitted to flow abruptly into the external space through the now widened spacing to be rapidly expanded and therefore cooled. Accordingly the electric arc 25 is blown out by the resulting stream of the cooled fluid.

In the closing operation, the operating mechanism (not shown) responds to a closure command signal to move the movable contact member 21 toward the stationary contact member 18 to engage the former with the latter after which the movable contact member 21 forcedly moves the stationary contact member 18 with the puffer piston 15 in the leftward direction as viewed in FIG. 3 or 4 against the action of the helical signal 20 until the piston 15 is seated on the annular end surface 17*a* of the supporting member 13 as shown in FIG. 3. At that time the closing operation is completed. During the closing operation the arc-extinguishing fluid from the external space is supplied via the spacing between the insulating cylindrical member 14 and the movable contact member 21 to the compression chamber 22 to be ready for the next succeeding interrupting operation.

In conventional switches such as shown in FIGS. 3 and 4 the puffer piston 15 is operated over the entire volume of the compression chamber 22 between the annular end surface 17*a* and the step 17*b* so that, upon separating of the two contact members from each other, the volume of the compression chamber 22 becomes extremely small thereby to make the fluid pressure within the chamber 22 extremely high. This has resulted in the disadvantages that the helical spring 20 is required to be very strong so that the closing operation requires a high-power operating mechanism sufficient to overcome such a strong spring and that the arc-extinguishing fluid within the compression chamber 22 can not absorb a large quantity of arc energy emitted into the compression chamber 22 particularly upon interruption of a high current while remaining at its low temperature. Accordingly, the fluid has reduced arc-extinguishing ability because of the elevated temperature thereof.

Also such switches have been disadvantageous in the following respects.

When the free end of the movable contact member 21 is moved to the flared insulating portion 14*b*, the fluid from the compression chamber 22 is rapidly delivered because of the extremely high pressure thereof. However, due to the small volume thereof, the compression chamber immediately loses the fluid resulting in a short blast time. Accordingly, in an extreme case, a current can be interrupted by such a short duration blast only when the current passes through its zero point in its alteration.

Further it has been difficult to increase the ability to interrupt low currents and to interrupt high currents simultaneously. More specifically, if the volume of the compression chamber is made so as to make the interrupting ability good for low currents then the interruption of a high current has resulted in the fluid within the compression chamber being heated and expanded by a large quantity of energy due to the electric arc struck across the contact members. This has caused the fluid within the compression chamber to be put under a very high pressure and also at an excessively elevated temperature resulting in an intense reduction in arc-extinguishing ability. Accordingly, even though the fluid at the excessively elevated temperature is blown against the electric arc, the latter has not been blown out.

Furthermore, when the contact members are separated from each other to strike an electric arc thereacross, the electric arc may further raise the fluid pressure within the compression chamber enough to overcome the resilience of the helical spring 20 tending to force the stationary contact member 18 toward the stationary contact member 21. Under these curcumstances, the stationary contact member 18 is pushed back by the fluid pressure within the compression chamber thereby to reduce the fluid pressure within the compression chamber and therefore the interrupting ability.

Also after the opening of the contact members, the re-closing operation is performed in such a manner that, upon both contact members 18 and 20 engaging each other, the stationary contact member receives a high impact force from the movable contact member so that this impact force cooperates with the resilience of the helical spring 20 to repeat the alternating disengagement and engagement between the contact members until the movable contact member ultimately engages the stationary contact member. That is, in the process terminating at this ultimate engagement a chattering occurs and electric arcs repeatedly strikes across the contact members resulting in their being fused to each other.

Figure 5:
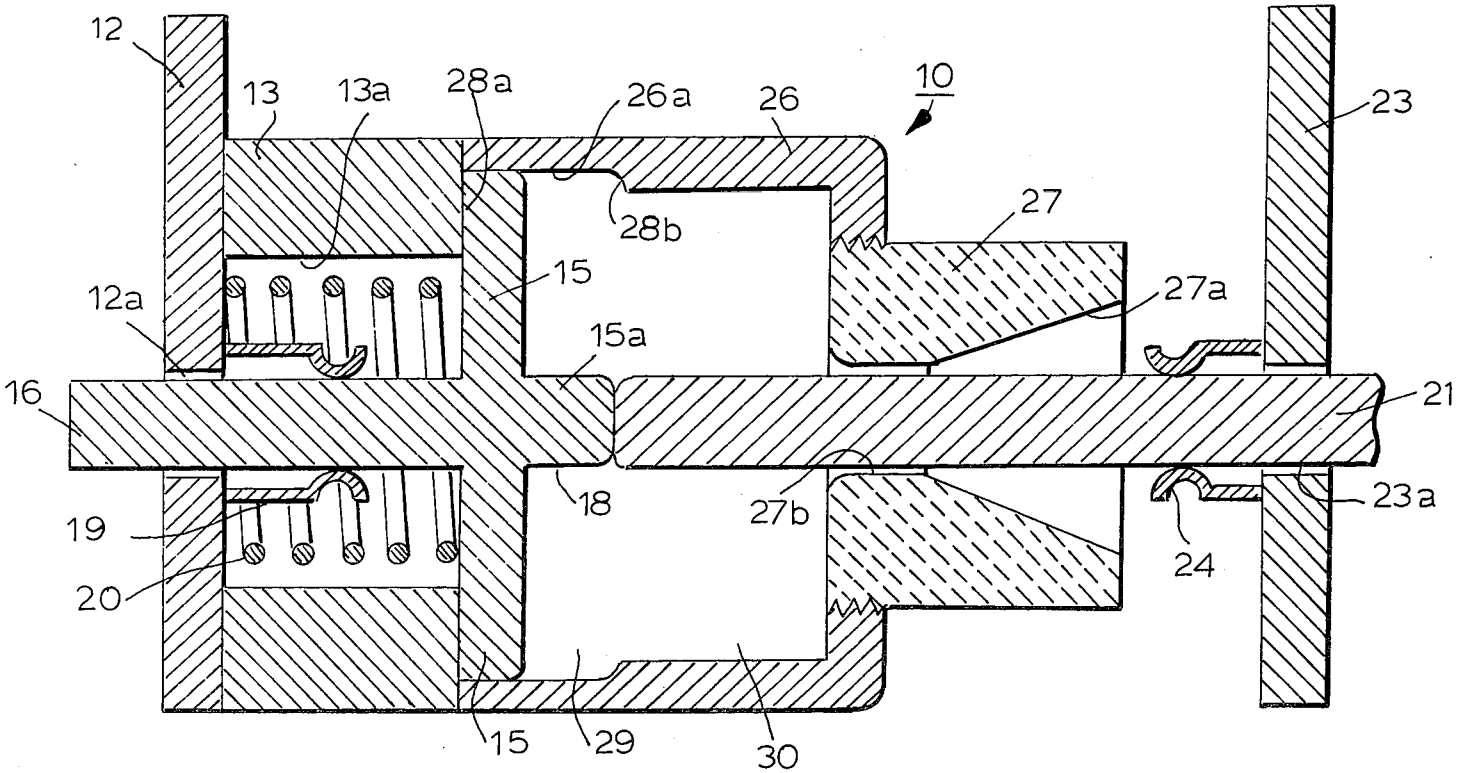
FIG. 5 is a longitudinal sectional view of one embodiment of the self-extinguishing type switch according to the present invention illustrated in its closed position with parts omitted.
Figure 6:
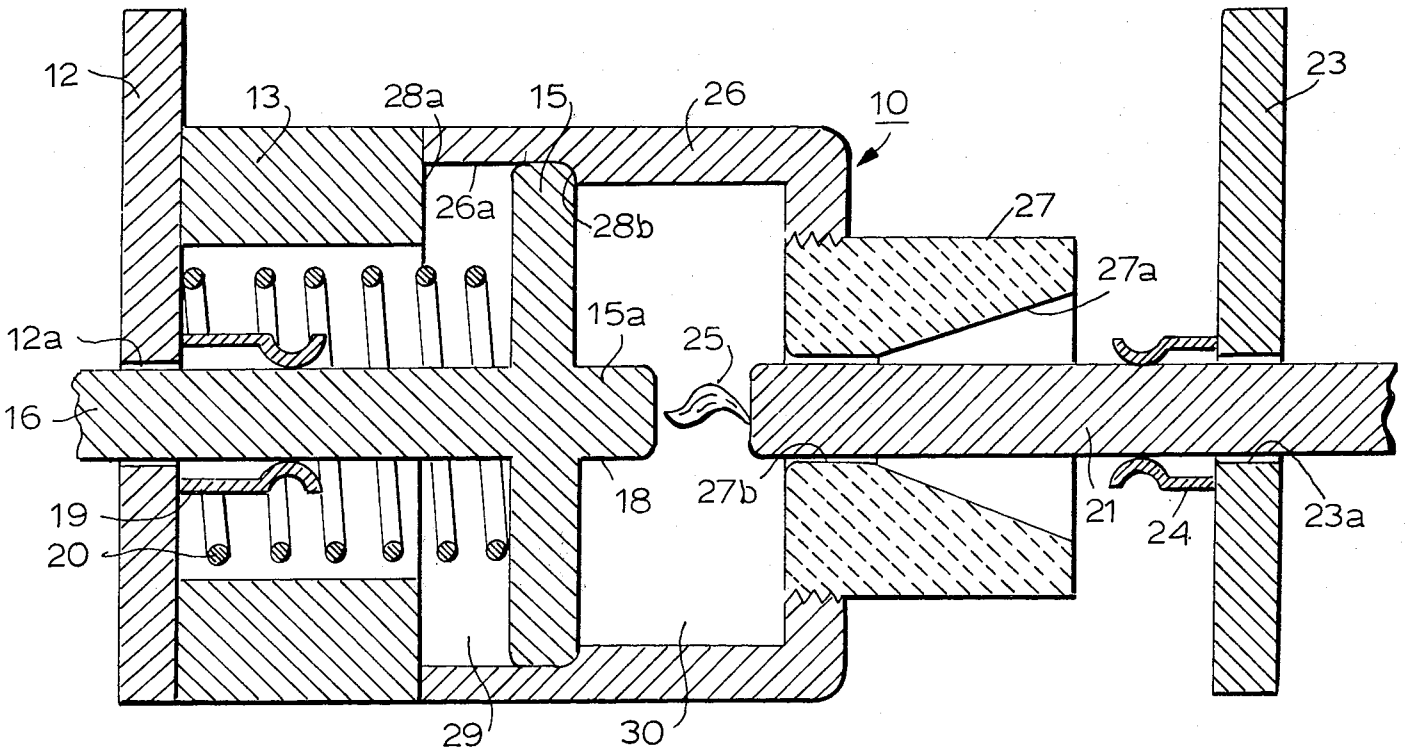
FIG. 6 is a view similar to FIG. 5 but illustrating the arrangement of FIG. 5 in its tripped position.

FIGS. 5 and 6 show one embodiment of the switching device according to the present invention in its closed and tripped positions respectively. The arrangement illustrated is different from that shown in FIGS. 3 and 4 in that in FIGS. 5 and 6 the hollow cylindrical, electrically insulating member 14 illustrated in FIGS. 3 and 4 is replaced by a hollow cylindrical metallic housing member 26 having one end open and the other end provided with a central opening into which a cylindrical electrically insulating nozzle 27 is firmly fitted.

More specifically, the hollow cylindrical member 26 is fixedly secured at the open end to the hollow cylindrical supporting member 13 and provided on the open end portion with a large diameter space 26*a* defining a compression chamber 29 with the annular end surface portion 28*a* of the supporting member 13 exposed to the large diameter space 26*a* and a circumferential rounded step 28*b* disposed on the inner wall surface of the hollow cylindrical member 26 spaced from the open end thereof a predetermined distance. The puffer piston 15 is slidably fitted into the compression chamber 29 to reciprocate between the annular end surface portion 28*a* and the circumferential step 28*b* serving as stops for limiting the movement of the puffer piston 15 within the compression chamber 29. Therefore the piston 15 has one peripheral corner toward the step 28*b* and complementary in shape to the step 28*b* and the other peripheral corner shaped into a right angle. The remaining space located within the hollow cylindrical member 26 between the step 28*b* and the other end thereof forms a reservoir 30 somewhat smaller in diameter than the compression chamber 29 for a purpose which will be subsequently apparent.

The insulating nozzle 27 is substantially similar to the free end portion of the electrically insulating member 14 shown in FIGS. 3 and 4 and includes a flared portion 27*a* similar to the flared portion 14*b* as described above.

In other respects, the arrangement is substantially identical to that shown in FIGS. 3 and 4.

From the foregoing it is seen that the arrangement shown in FIGS. 5 and 6 includes the compression chamber 29 located on that side thereof adjacent to the supporting member 13 and the reservoir 30 located on the other side thereof and continuous with compression chamber 29. The compression chamber 29 has a volume capable of being reduced to substantially a null magnitude by the puffer piston 15 and the reservoir 30 serves to accumulate the arc-extinguishing fluid compressed within the compression chamber 29.

As in the arrangement shown in FIGS. 3 and 4 the operating mechanism (not shown) is operated to move the movable contact member 21 in the rightward direction as viewed in FIG. 5 which is attended with the similar movement of the stationary contact member 18 with the puffer piston 15 resulting from the resilience provided by the helical spring 20. This results in the compression of the fluid within the compression chamber 29.

When the movable contact member 21 is further moved in the rightward direction, the puffer piston 15 abuts the stop 28*b* whereupon the stationary contact member 18 is prevented from being further moved in the rightward direction. Therefore contact members 21 and 18 are separated from each other resulting in an electric arc 25 striking across both contact members as shown in FIG. 6.

At that time, the volume of the compression chamber 29 becomes substantially null while the reservoir 30 accumulates the fluid increased in pressure. However, the total volume of the compression chamber 29 and the reservoir 30 has a small rate of change so that the fluid pressure is prevented from rising excessively. Also thermal energy resulting from the electric arc 25 struck across both contact members 21 and 18 is utilized to raise the fluid pressure within the reservoir 30 but due to the large volume of the reservoir 30, the fluid is prevented from increasing exxcessively in both pressure and temperature even when interrupting high currents. This means that a large amount of the fluid under a high pressure at a sufficiently low temperature can be accumulated within the reservoir 30 for interrupting high currents.

Thereafter the process as described above in conjunction with FIGS. 3 and 4 is repeated to extinguish the electric arc 25. In the arrangement shown in FIGS. 5 and 6 it is noted that, because of the large volume of the reservoir 30, the arc-extinguishing fluid having an pressure within the reservoir 30 can blow against the electric arc for a long time interval. This makes it possible to interrupt the particular current in a stable manner even though the current will pass through its zero point at any time.

From the foregoing it is seen that the present invention comprises the compression chamber for compressing the arc-extinguishing fluid therein by decreasing its volume substantially to a zero magnitude and a reservoir adjacent to the compression chamber in fluid communication therewith. Therefore it is possible to accumulate a large amount of the fluid having a proper pressure and a low temperature. This results in the interrupting performance being stabilized throughout a current range from a low to a high magnitude.

Figure 7:
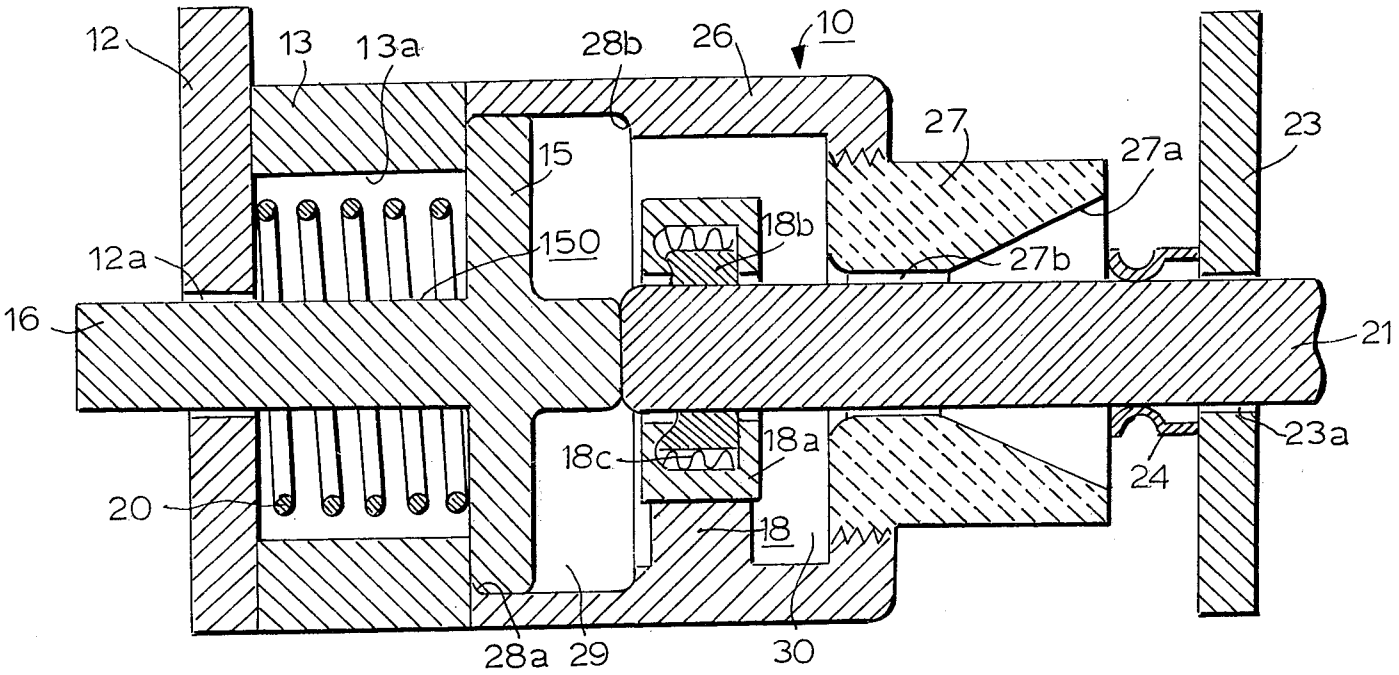
FIGS. 7 and 8 are views similar to FIGS. 5 and 6 respectively but illustrating a modification of the arrangement shown in FIGS. 5 and 6.
Figure 8:
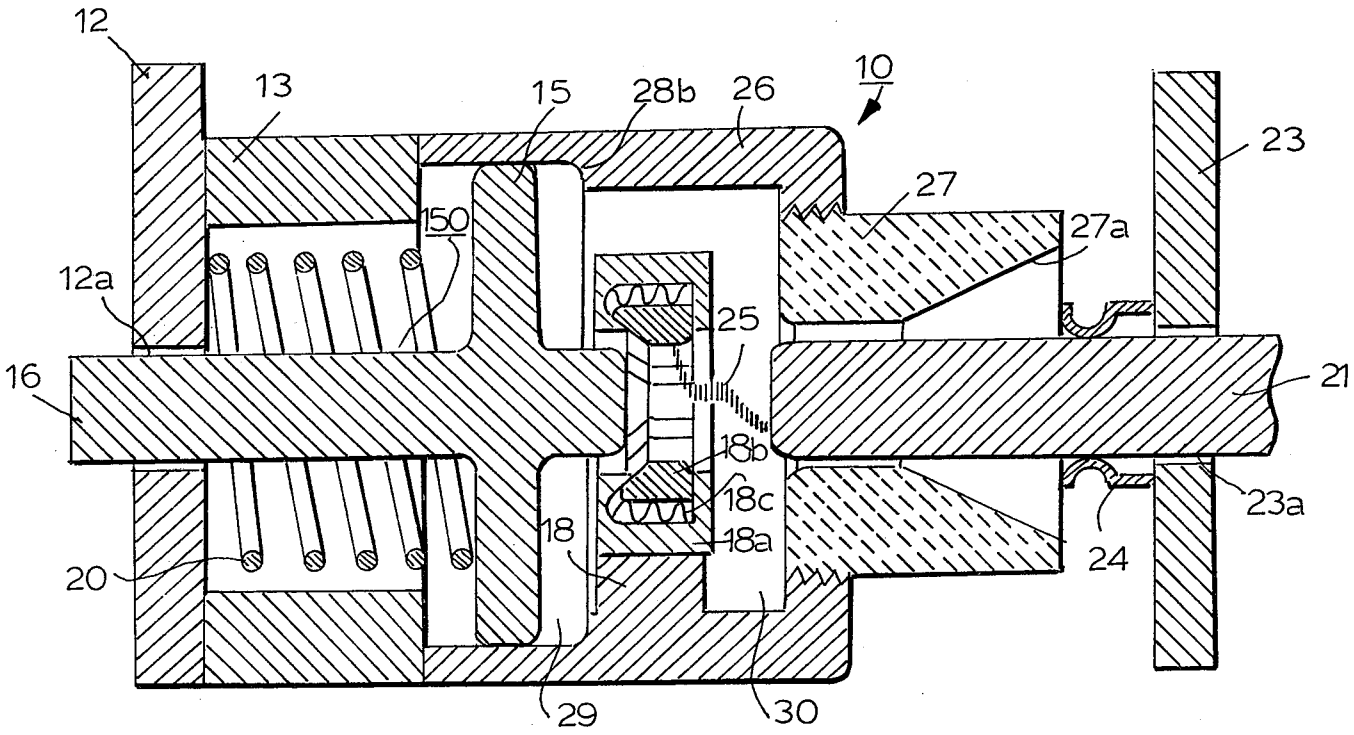

FIGS. 7 and 8 illustrate a modification of the arrangement shown in FIGS. 5 and 6 in its closed and tripped positions respectively. The arrangement illustrated is different from that shown in FIG. 5 principally in that in FIG. 7, the stationary contact member 18 is disposed in the reservoir and is connected to the inner wall surface of the hollow cylindrical member 26.

More specifically, the stationary contact member 18 includes a hollow disc-shaped case 18*a* provided on the opposite surfaces with central aligned apertures and coaxially disposed within the reservoir 30 and connected to the inner wall surface of the latter. Disposed in the case 18*a* is a split contact 18*b* having an inside diameter sufficient to permit the movable contact member 21 to extend therethrough and normally biased toward the central axis of the case 18*a* by leaf springs 18*c* disposed between the outer peripheral surface of the split contact 18*b* and the inner wall surface of the case 18*a*. As shown in FIG. 7 the movable contact member 21 in its closed position extends through the split contact 18*b* and is placed in good engagement with the latter by means of the action of the springs 18*c*. Further the movable contact member 21 in its closed position has its free end protruding somewhat from the case 18*a* to engage a slider generally designated by the reference numeral 150. The slider 150 is identical in both shape and operation to the stationary contact member 18 shown in FIGS. 5 and 6 excepting that no current flows through the slider 150. Therefore the slider 150 is formed of an electrically insulating material and the collector 19 shown in FIGS. 5 and 6 is omitted in FIGS. 7 and 8.

In other respects the arrangement is substantially identical to that shown in FIGS. 5 and 6.

Accordingly it will readily be understood that the arrangement of FIG. 7 is substantially identical in operation to that shown in FIGS. 5 and 6 except for an electric arc 25 striking across the free end of the movable contact member 21 and the inner peripheral surface of the split contact 18*b* as shown in FIG. 8.

Since the slider 150 does not form a current-carrying path and the associated collector is omitted, the same receives no contact pressure due to the collector. Accordingly there is no drag due to such a contact pressure and a repulsion resulting from a current which will otherwise flow through the slider. This permits the helical spring 20 to have reduced resilience. Further the chattering can be avoided because the stationary contact member 18 is located so as not to be struck by the movable contact member 21. This results in a reduction in wear and tear of the contact members caused by the electric arcs struck thereacross.

The electrically insulating nozzle 27 may have an increased diameter cylindrical hole and the stationary contact member 18 can be disposed in this large diameter hole.

The slider 150 may be partly or entirely formed of a metallic material.

Figure 9:
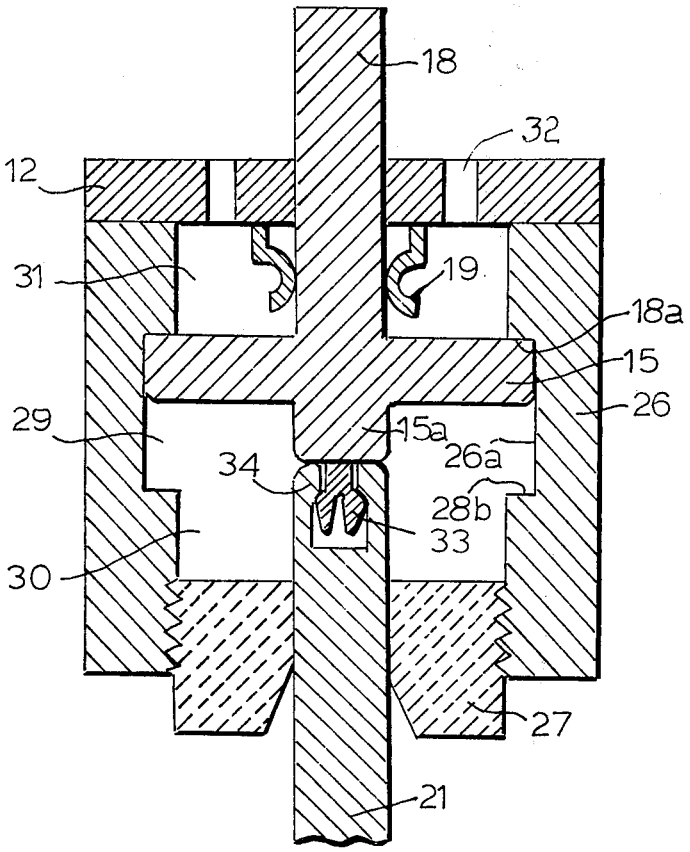
FIGS. 9 and 10 are views similar to FIGS. 5 and 6 respectively but illustrating another modification of the arrangement shown in FIGS. 5 and 6.

FIG. 9 shows a modification of the present invention. In the arrangement illustrated the puffer cylinder 10 or the hollow cylindrical member 26 includes the large diameter space portion 26*a* disposed in the axially middle portion. An apertured terminal plate 12 in the form of a disc closes one end, in this case, the upper end as viewed in FIG. 9 of the cylinder 10 and an electrically insulating nozzle 27 similar to the nozzle 27 as shown in FIGS. 5 and 6 screw threaded into the other or lower end portion thereof.

A stationary contact member 18 substantially identical to that shown in FIGS. 5 and 6 is provided, and has a puffer piston 15 slidably fitted into the large diameter portion 26*a* forming a compression chamber 29 to reciprocate therein between a pair of circumferential flat steps 28*a* and 28*b*. The stationary contact member 18 includes an arm portion slidably extending through a central hole in the terminal plate 12 and engaging a collector 19 disposed on the inner surface of the terminal plate 12, the helical spring 20 as shown in FIGS. 5 and 6 being omitted. Therefore the stationary contact member 18 is electrically connected to an external electric device through the collector 19 and the terminal plate 12.

The puffer piston 15 partitions the interior of the puffer cylinder 10 into a pair of upper and lower chambers 31 and 30 respectively equal in diameter to each other and somewhat smaller in diameter than the large diameter space portion 26*a*. The upper chamber 31 communicates with the arc-extinguishing fluid disposed in the external space through a plurality of holes 32 extending through the terminal plate 12. The lower chamber includes the compression chamber 29 formed of the large diameter space portion 26*a* and the reservoir 30 continuous with the compression chamber 29.

The puffer cylinder 10 is held at its position illustrated in FIG. 9 by a supporting member (not shown) so that the puffer piston 15 abuts against the upper stop 28*a*.

A movable contact member 21 operatively coupled to an operating mechanism (not shown) slidably extends through an axial hole of the insulating nozzle 27 similar to that shown in FIGS. 5 and 6 to engage the stationary contact member 18 at its closed position.

As shown in FIG. 9, a central raised portion 15*a* of the puffer piston 15 includes a tulip-shaped contact 33 pendent from the end thereof and tapered toward its end while the movable contact member 21 is provided on the free end portion with a recess 34 having an enlarged inner portion in the form of a bottle. At the closed position the stationary contact member 18 detachably engages the movable contact member 21 by having the tulip-shaped contact 33 resiliently inserted into the bottle-shape recess 34. Therefore the tulip-shaped contact 33 forms a snap hook type coupling with the bottle-shaped recess 34. This coupling is maintained in the engaged state until it receives a force, in this case, a trip force of a predetermined magnitude. Under a trip force in excess of the predetermined magnitude the contact 33 of the coupling disengages from the recess thereof.

Figure 10:
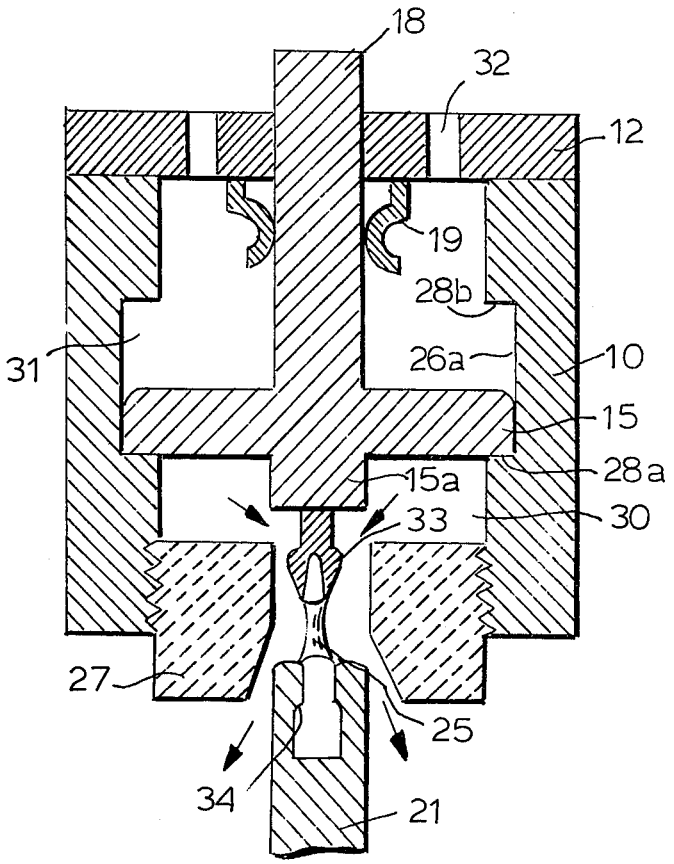

As in the arrangement of FIG. 5, the operating mechanism (not shown) is operated to move the movable contact member 21 downward as viewed in FIG. 9. Because the tulip-shaped contact is maintained in engagement with the bottle-shaped recess 34, the stationary contact member 18 is also moved downward with the moving contact member 21 to cause the piston 15 to compress the fluid disposed in the compression chamber 29 and the reservoir 30. When the piston 15 abuts the lower step 28*b* on the large diameter space portion 26*b*, the stationary contact member 18 is prevented from further descending while the movable contact member continues to descend. As a result, a trip force in excess of the predetermined magnitude as described above is applied to the coupling 33-34 to cause the contact 33 to disengage from the recess 34 resulting in the separation of both contact members 18 and 21. At that time an electric arc 25 strikes across both members as shown in FIG. 10.

Thereafter the process as described above in conjunction with FIGS. 3 and 4 is repeated to extinguish the electric arc 25.

From the foregoing it is seen that, since the operating mechanism (not shown) is required only to operate the stationary contact member 18 including the puffer piston 15 and the movable contact member 21, it is possible to make the weight of operated components small as compared with the prior art practice. In addition, to minimize the duration of the electric arc, for which the speed of separation of the movable contact member 18 is required to be at the highest magnitude, it is sufficient to operate the movable contact member 21 alone. Therefore the speed of separation can be made sufficiently high using a force provided by a low-power operating mechanism. Accordingly the interrupting performance can be improved with a small-sized, inexpensive construction.

While the arrangement of FIG. 9 includes the tulip-shaped contact 33 formed of an electrically conductive material, it is to be understood that the contact 33 may be formed of an electrically insulating material. In the latter case, the re-engagement of the contact 33 with the recess 34 does not result in a current flowing therethrough upon the engagement. This causes a reduction in fear that an electric arc will strike across the two upon the engagement resulting in their fusion. Therefore the use of the electrically insulating contact is advantageous for high rated current circuits.

Figure 11:
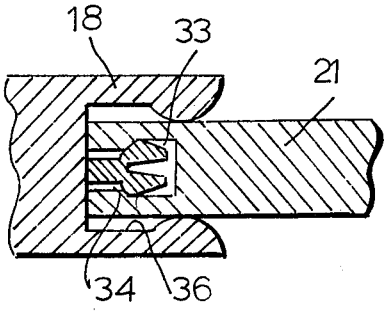
FIGS. 11 and 12 are longitudinal sectional views of a modification of the coupling shown in FIGS. 9 and 10 illustrated in its closed and tripped positions respectively.
Figure 12:
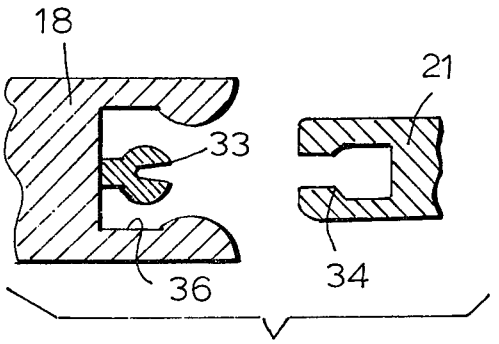

The coupling as described above may be modified as shown in FIGS. 11 and 12. In the arrangement illustrated the stationary contact member 18 is provided on the free end surface portion with a recess 36 having a contracted portion located adjacent to its mouth which is sufficient to permit the recessed end portion of the movable contact member 21 as shown in FIG. 9 to be resiliently inserted into the recess 36 as shown in FIG. 11. The tulip-shaped contact 33 is disposed at the bottom of the depression 36 and resiliently inserted into the recess 34 at its closed position. FIG. 12 shows the free end portions of contact members 18 and 21 at their tripped positions. In the arrangement shown in FIGS. 11 and 12, an electric arc strikes across the free ends of contact members 18 and 21 so that the contact 33 is prevented from being exposed to the electric arc.

Figure 13:
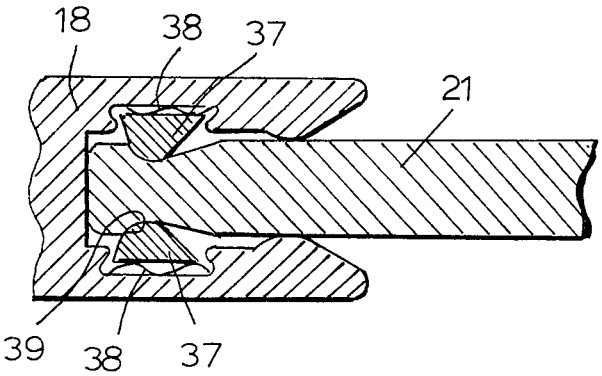
FIGS. 13 and 14 are views similar to FIGS. 11 and 12 respectively but illustrating another modification of the coupling shown in FIGS. 9 and 10.
Figure 14:
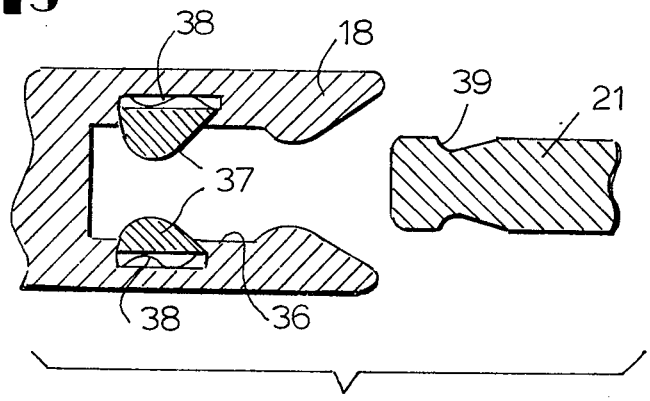

Also, as shown in FIGS. 13 and 14, the depression 36 can be provided on the inner peripheral surface with a pair of diametrically opposite notches in which a pair of engaging members 37 formed of an electrically conductive material are disposed in diametrically opposite relationship, and the tulip-shaped contact 33 can be omitted. A leaf spring 38 is interposed between each engaging member 37 and the mating notch to bias the engaging element in a radially inward direction.

On the other hand, the movable contact member 21 includes a pair of diametrically opposite notches 39 located at positions where the notches 21 engage the respective engaging members 37 when contact members 18 and 21 engage each other as shown in FIG. 13. To this end, the notch 39 is complementary in shape to the mating engaging member 37.

FIG. 14 shows the free end portions of contact member 18 and 21 in their tripped positions.

Figure 15:
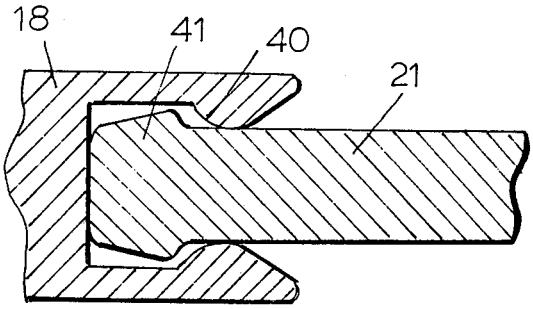
FIGS. 15 and 16 are views similar to FIGS. 9 and 10 respectively but illustrating still another modification of the coupling shown in FIGS. 9 and 10.
Figure 16:
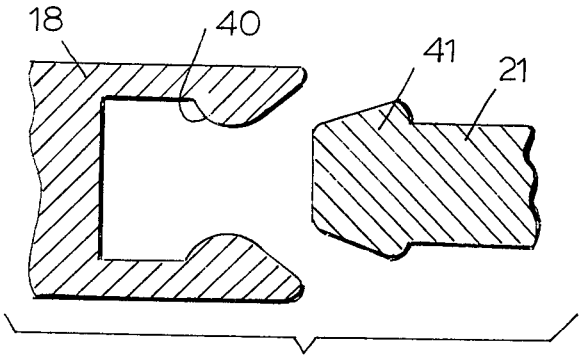

In FIGS. 15 and 16, the stationary contact member 18 has the free end portion shaped into a depression similar to that shown in FIG. 11, that is, having a contracted portion 40 located adjacent to its mouth while the free end portion of the movable contact member 21 includes a circumferential enlarged portion 41 sufficient to pass resiliently through the contracted portion 40 and tapered toward the free end substantially equal in diameter to the main body of the movable contact member 21. As shown in FIG. 15, the free end of the movable contact member 21 at its closed position rests at the bottom of the depression on the stationary contact member 18. FIG. 16 shows the free end portions of contact members 18 and 21 in their tripped positions. The arrangement shown in FIGS. 15 and 16 is advantageous over the arrangements shown in FIGS. 9, 10, FIGS. 11, 12 and FIGS. 13, 14 in that both free end portions are prevented from easily disengaging from each other yet does not require an additional component or components in the stationary contact member 18.

Figure 17:
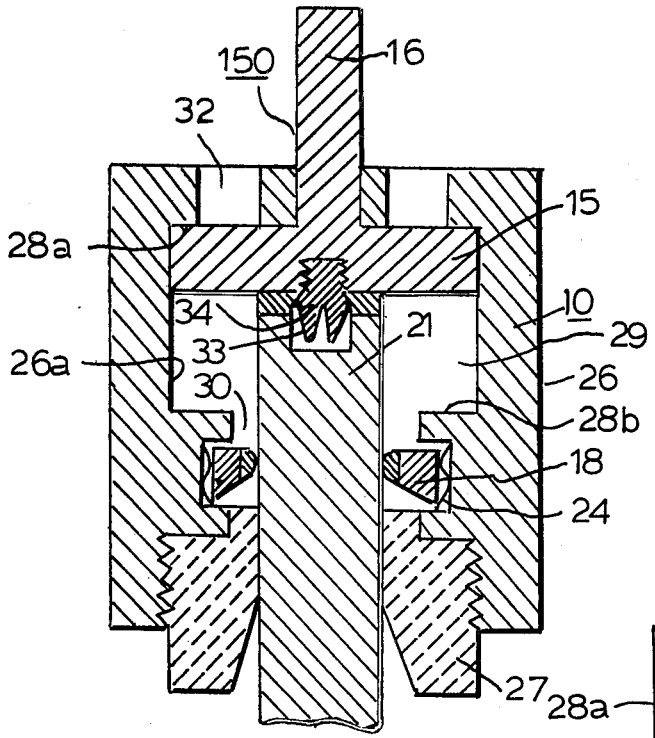
FIGS. 17 and 18 are views similar to FIGS. 9 and 10 respectively but illustrating a modification of the arrangement shown in FIGS. 9 and 10.

The arrangement illustrated in FIG. 17 is different from that shown in FIG. 9 principally in that in FIG. 17, the stationary contact member is disposed within the reservoir 30. More specifically, a pair of stationary contact members 18 are disposed in diametrically opposite relationship within the reservoir 30 with their bottom located in associated notches also disposed in diametrically opposite relationship on the inner wall surface of the reservoir 30. A leaf spring 42 is disposed in the mating notch to bias normally the associated stationary contact member 18 in the radially inward direction. Therefore, at their closed position the stationary contact members 18 are in sliding engagement with the outer peripheral surface of the movable contact member 21 extending past the same (see FIG. 17). Further the tulip-shaped contact 33 is directly screw threaded into the surface of the puffer piston 15 and the central raised portion thereof (see FIG. 9) is omitted, and the compression chamber 29 reaches to the terminal plate integral with the cylindrical member 26. Therefore, the upper chamber 31 (see FIG. 9) is omitted. Because the stationary contact members 18 are disposed within the reservoir 30, the piston 15 and the guide rod 16 therefor forms an arc contact member 150 and also serves as the slider 150 as described above in conjunction with FIG. 7. Therefore, the collector 19 (see FIG. 9) is omitted.

In other respects, the arrangement is substantially identical to that shown in FIGS. 9 and 10.

In the opening operation, the tulip-shaped contact 33 on the piston 15 first disengages from the recess 34 on the movable contact member 21 after the piston 15 has reached the lower step **28*b*. Then the movable contact member 21 disengages from the stationary contact members 18 to cause an electric arc 25 as shown in FIG. 18**.

Figure 18:
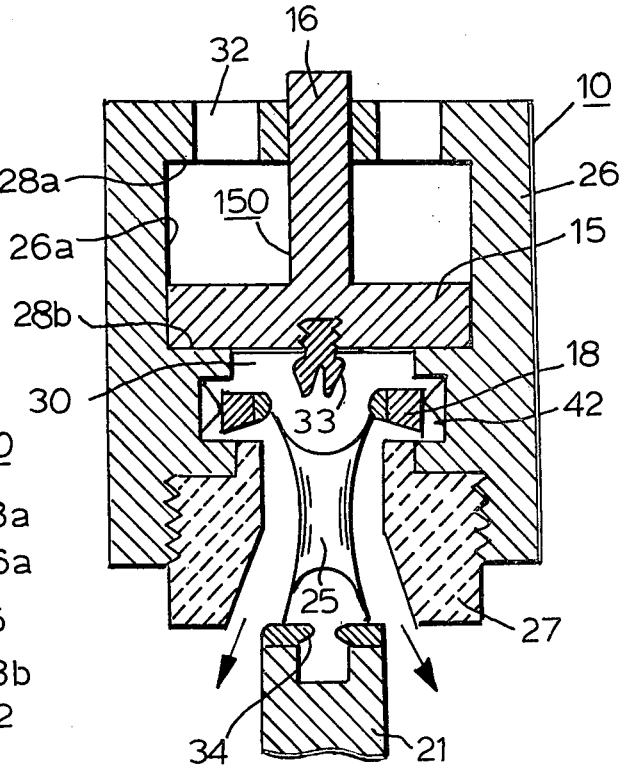

In the closing operation, the movable contact member 21 is moved upward as viewed in FIG. 18 to fit the free end portion thereof into the space between the opposite stationary contact members 18 to engage it with the latter at that time, and a current flows through contact members 18 and 21 after which the movable contact member 21 abuts the piston 15 to force it upwardly until the piston 15 abuts the step **28*a* on the terminal plate 12 to be prevented from ascending further. At that time the tulip-shaped contact 33 on the piston 15 resiliently forced into the recess 34 on the movable contact member 21 so as to be returned to its original position as shown in FIG. 17**.

In FIGS. 17 and 18 the stationary and movable contact members 18 and 21 respectively are shown as having respective contacts attached to the free ends thereof. However, in the foregoing Figures and some of the subsequent Figures, those contacts are omitted only for purposes of illustration. Also in some of the subsequent Figures such contacts are illustrated without the reference numerals identifying the same.

Figure 19:
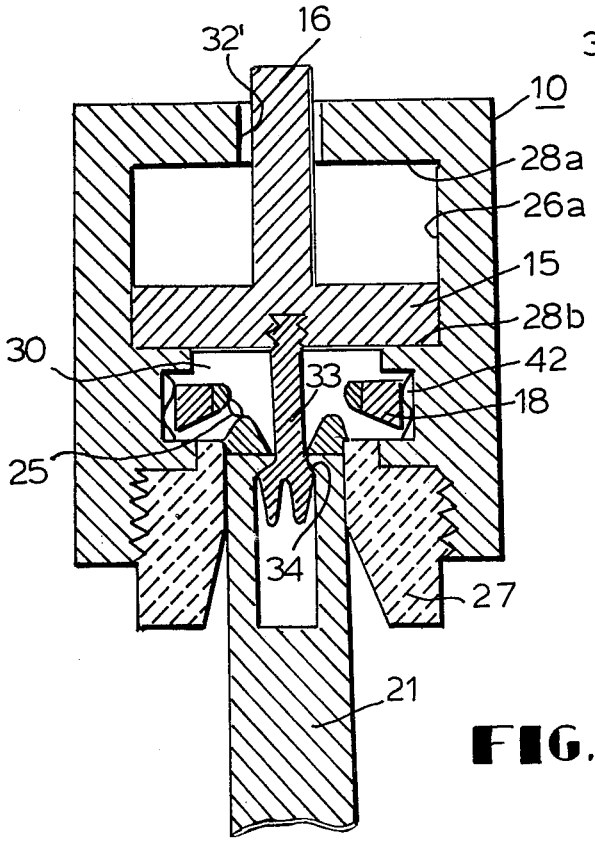
FIG. 19 is a view similar to FIG. 17 but illustrating in its closed position a modification of the arrangement shown in FIGS. 17 and 18.

In FIG. 19, the tulip-shaped contact 33 has an increased axial length while the recess 34 has a correspondingly increased depth. Also a clearance 32' is formed around the guide rod 16 for the piston 15 within the central hole on the terminal plate 12 in place of the through holes 32 as shown in FIG. 17.

In other respects, the arrangement illustrated is identical to that shown in FIG. 17.

In FIG. 19 it is seen that the tulip-shaped end portion of the contact 33 on the stationary contact member 18 can disengage from the recess 34 on the movable contact member 21 immediately after both contact members have disengaged from the movable member 21 each of the contact members strike an electric arc thereacross. This permits a reduction in extent to which the puffer piston 15 tends to be moved away from the movable contact member 21 by means of the pressure of the compressed fluid upon the contact 33 disengaging from the recess 34. Accordingly, a more effective puffer action can be expected.

Figure 20:
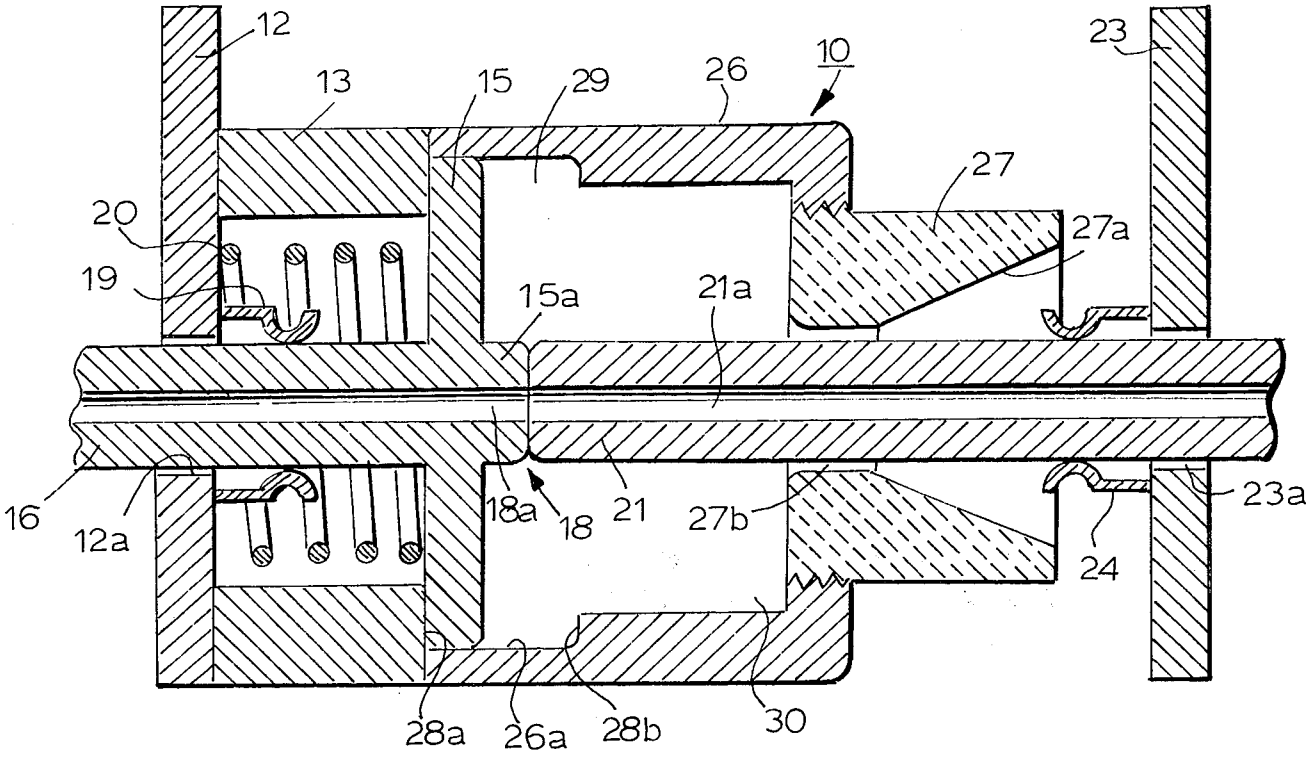
FIG. 20 is a longitudinal sectional view of a modification of the present invention illustrated in its closed position with parts omitted.

The arrangement of FIG. 5 can be modified as shown in FIG. 20. In FIG. 20, the stationary contact member 18 includes an axial exhaust passageway 18A extending throughout its length and axially aligned with an axial exhaust passageway 18B similarly extending throughout the length of the movable contact member 21. Both exhaust passageways 18A and 18B serve to cause the compression chamber 29 to be connected in fluid communication with the external space therethrough. However, when the two contact members are engaged with each other, the compression chamber 29 is not in communication with the axial exhaust passageways 18A and 21A.

Figure 21:
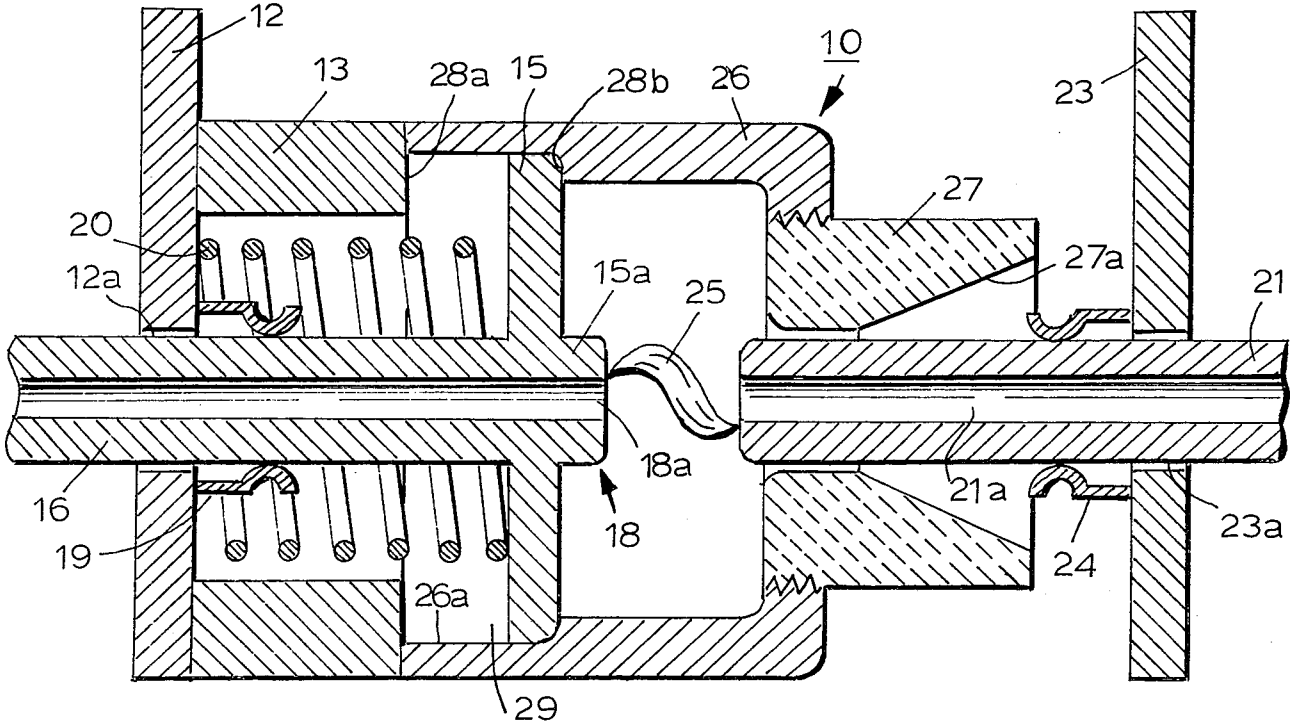
FIG. 21 is a view similar to FIG. 20 but illustrating the arrangement of FIG. 20 illustrated in its tripped position.

The movable contact member 21 is separated from the stationary contact member 18 in the same manner as described above in conjunction with FIG. 5. At that time an electric arc 25 strikes across contact members 18 and 21 and the compression chamber 29 communicates with the external space through the axial exhaust passageways 18A and 21A as shown in FIG. 21. Under these circumstances, the arc-extinguishing fluid compressed in the reservoir 30 is exhausted into the external space through the passageways 18A and 21A while it cools the electric arc 25. For a low interrupted current, the electric arc 25 can be extinguished only by means of the cooling action due to the blast of that compressed fluid.

For a high interrupted current, however, the resulting electric arc 25 has a large diameter sufficient to close the exhaust passageways 18A and 21A. Therefore, the fluid pressure in the compression chamber 29 is not lowered and inversely is raised because thermal energy due to the electric arc 25 is partly accumulated in the reservoir 30. However since one portion of the fluid is exhausted into the external space through the exhaust passageways 18A and 21A, the fluid within the reservoir 30 is prevented from excessively increasing in both pressure and temperature.

When the free end of the movable contact member 21 enters the flared portion **27*a* of the electrically insulating nozzle 27, the fluid from the reservoir 30 is rapidly discharged to the external space as in the arrangement shown in FIGS. 5 and 6. The fluid thus dicharged has a relatively high pressure and a relatively low temperature which cooperates with a large opening area of the nozzle 27 to permit a large amount of the fluid to blow against the electric arc 25. As a result, the electric arc 25** is satisfactorily cooled and extinguished even though the particular interrupted current is high.

From the foregoing it will readily be understood that, after contact members 18 and 21 have disengaged from each other, low currents can be rapidly interrupted by means of the piston action of the puffer piston 15 combined with the axial exhaust passageways 18A and 21A extending through the stationary and movable contact members 18 and 21 respectively. Also for interrupting high currents, the fluid having both increased pressure and temperature due to the resulting electric arc is partly exhausted through the exhaust passageways 18A and 21A immediately after the occurrence of the electric arc. This prevents the pressure and temperature in the interior of the reservoir 30 from increasing excessively. Thereafter the free end of the movable contact member 21 enters the flared portion **27*a* of the insulating nozzle 27** whereupon the fluid having sufficient arc-extinguishing power can blow against the electric arc. This can smoothly cool and extinguish the electric arc.

Also since the contact member includes the axial exhaust passageway, convection is apt to occur when a current flows through the contact member. Where the exhaust passageway extends through each of the stationary and movable contact members as in the arrangement of FIG. 21, the effect of this convection is particularly conspicuous.

In summary, the arrangement shown in FIGS. 20 and 21 can achieve an excellent interrupting performance for both low and high currents with a simple, inexpensive construction and still increase the current flowing through the stationary and movable contact members.

Figure 22:
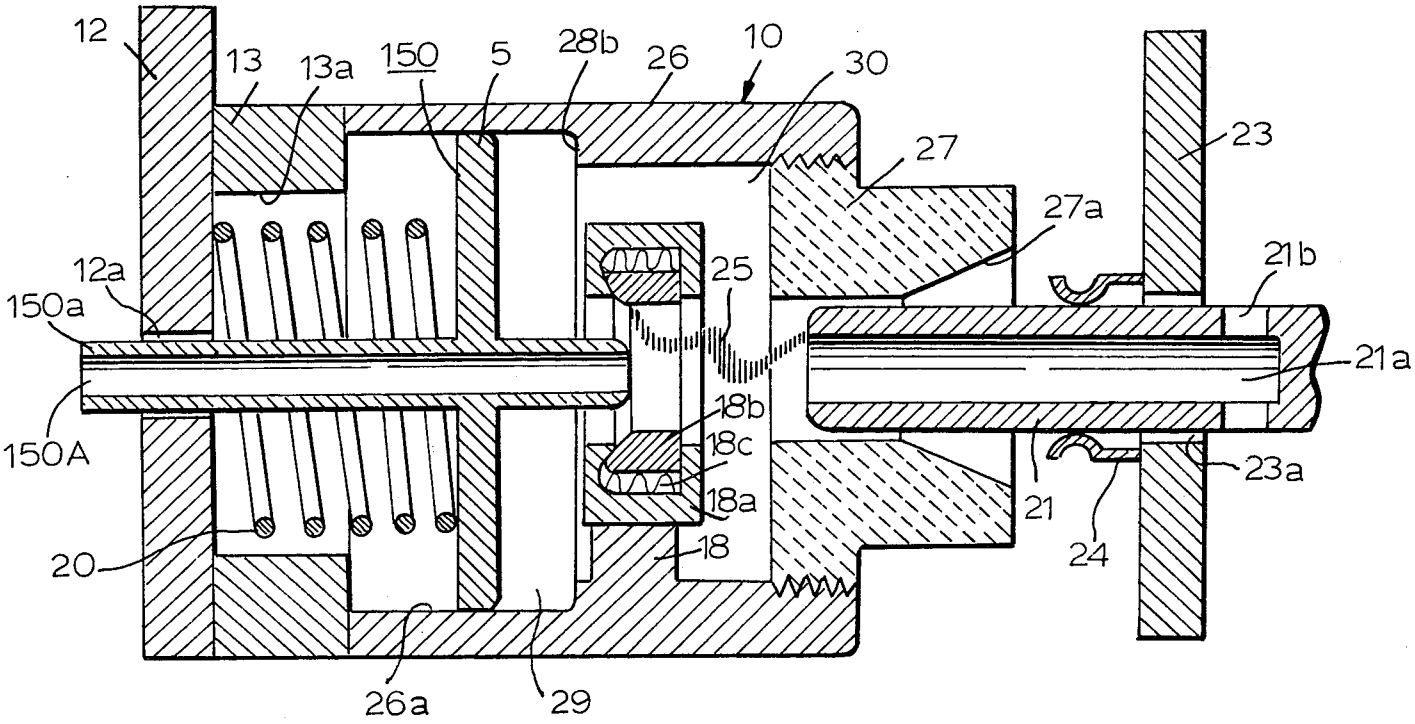
FIG. 22 is a view similar to FIG. 8 but illustrating a modification of the arrangement as shown in FIGS. 20 and 21 applied to the arrangement shown in FIGS. 7 and 8.

The arrangement illustrated in FIG. 22 is different from that shown in FIG. 7 in that the slider 150 is formed of a metallic material to provide an arc contact member as in the arrangements shown in FIGS. 17 and 18 and that axial exhaust passageways 150A and 21A extend throughout the length of the arc and movable contact members 150 and 21 respectively.

Figure 23:
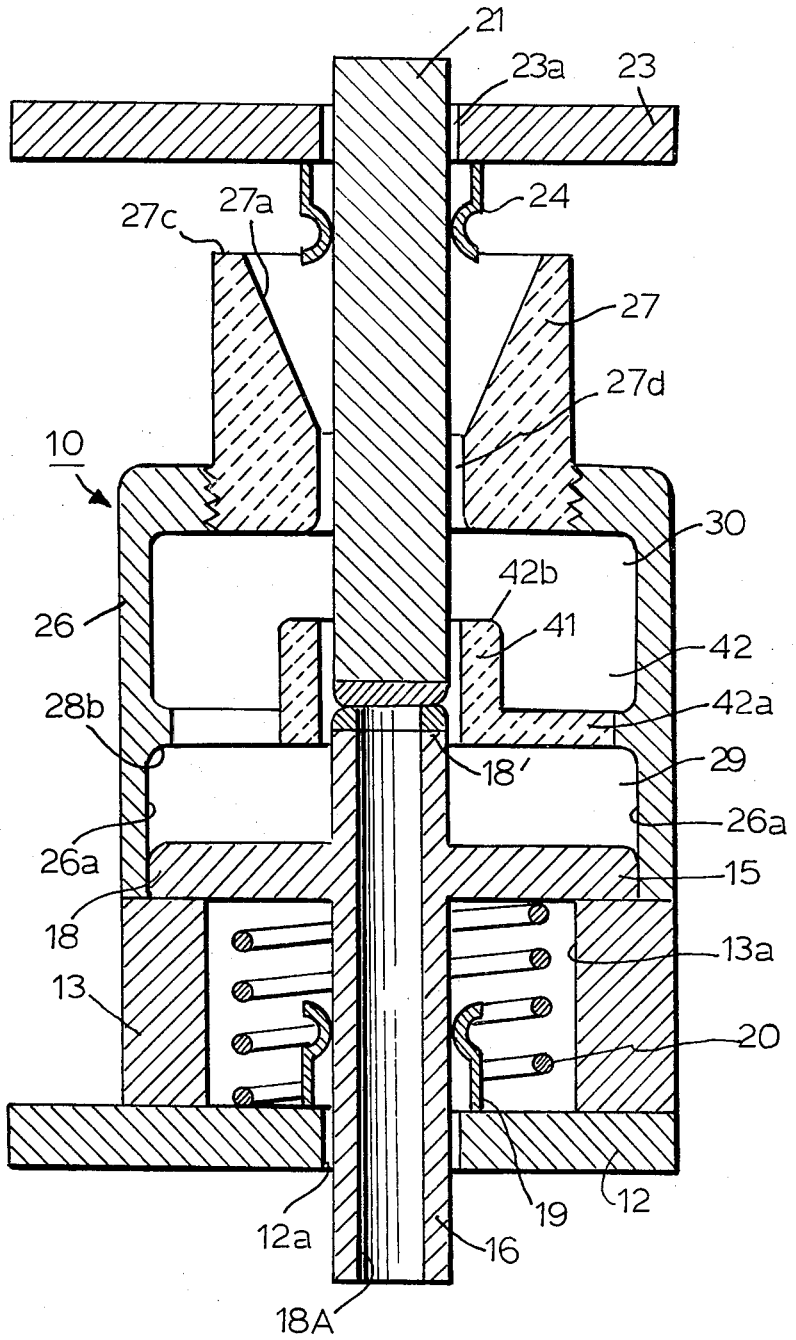
FIG. 23 is a longitudinal sectional view of another modification of the present invention illustrated in its closed position with parts omitted.

FIG. 23 shows another modification of the present invention. The arrangement illustrated is different from that shown in FIG. 5 only in that in FIG. 23, an encircling member is provided which encircles the free end portions of the stationary and movable contact members and the stationary contact member includes an axial exhaust passageway extending throughout the length thereof. More specifically, the encircling member 42 includes an apertured partition **42*a* fixed at the outer periphery to a radially inward directed circumferential rib located on the inner wall surface of the hollow cylindrical member 26 between the compression chamber 29 and the reservoir 30, which are equal in diameter to each other. That lateral surface of the rib facing the piston 15 forms the circumferential step 28*b* or the stop for the piston 15**.

The encircling member 42 includes a relatively short sleeve **42*b* extending from the central portion of the partition 42*a* toward the nozzle 27 and the partition 42*a* includes a plurality of radial openings disposed at predetermined equal angular intervals thereon and extending from the outer periphery of the sleeve 42*b* to the outer edge of the partition 42*a* (only one of which is illustrated) thereby to put the compression chamber 29 in fluid communication with the reservoir 30. The encircling member 42** is formed of an electrically insulating material.

Figure 24:
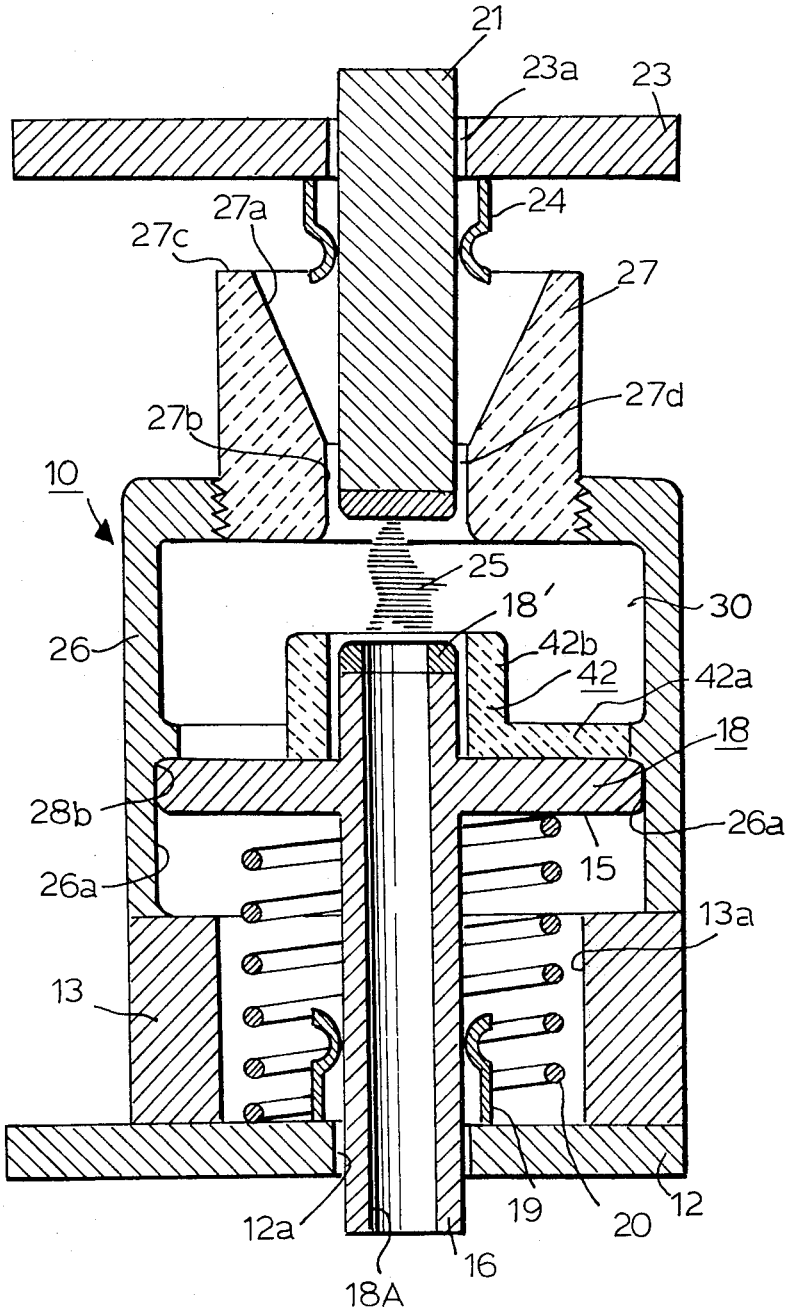
FIGS. 24 and 25 are views similar to FIG. 23 but illustrating the arrangement of FIG. 23 in two different tripped positions thereof.

The sleeve **42*b* is so dimensioned that the stationary and movable contact members 18 and 21 respectively can be inserted thereinto with a minute clearance formed therebetween as shown in FIGS. 23 and that the free end of the stationary contact member 18 extends to a point just short of that end of the sleeve 42*b* nearer to the nozzle 27 upon the completion of the interruption as shown in FIG. 24. In their closed position, contact members 18 and 21 engage each other within the sleeve 42*b*** adjacent to the other end thereof.

Therefore the sleeve **42*b* can encircle the stationary contact member 18 over a predetermined length measured in the direction of separation of the movable contact member 21** to the free end thereof.

Figure 25:
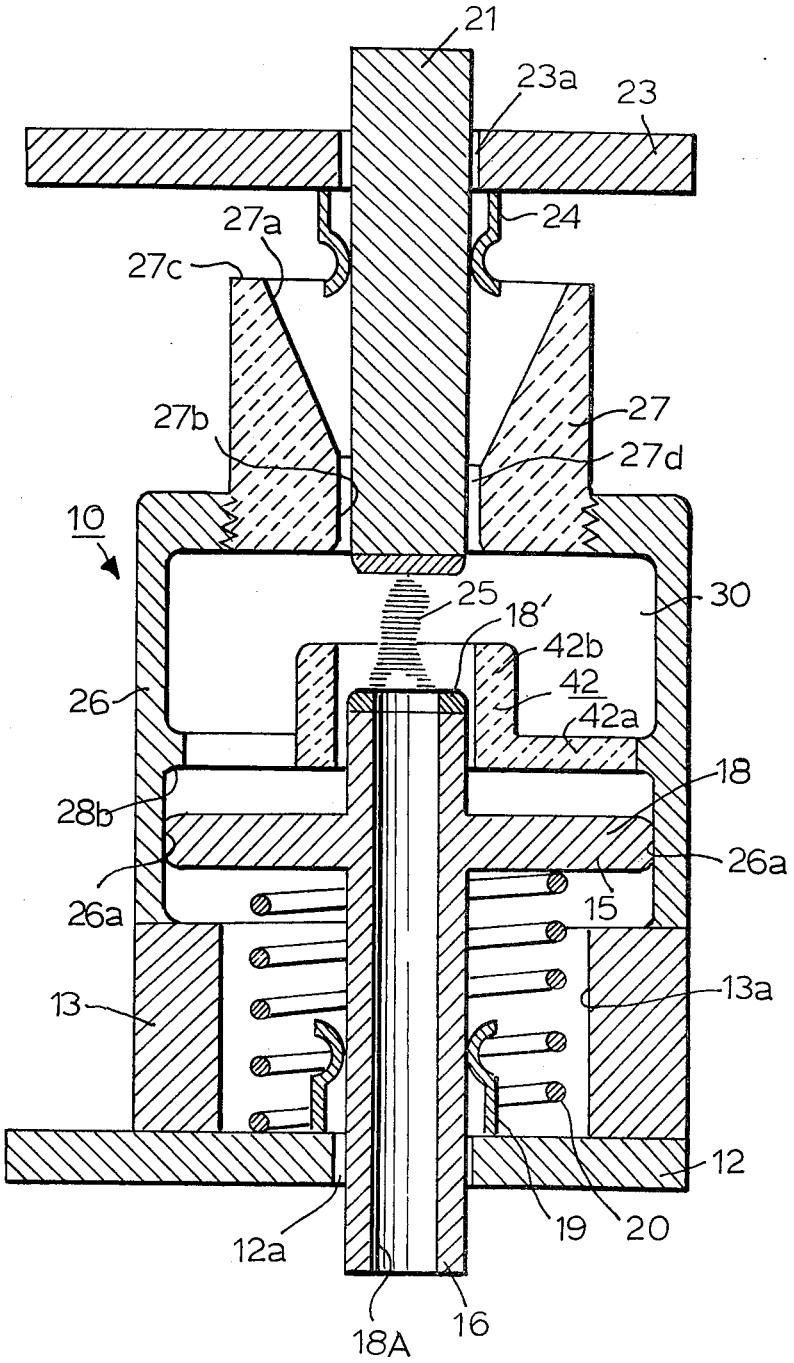

The encircling member 42 serves to permit the arc-extinguishing fluid within the reservoir 30 to be delivered to the external space only after fluid has penetrated the electric arc and to retain a low temperature fluid in the reservoir 30 while the fluid in the reservoir 30 is prevented from increasing in temperature. In addition the encircling member 42 is effective for blowing the low temperature fluid that has been accumulated in the reservoir 30 by the piston 15 axially even when chattering occurs between contact members 18 and 21 to strike electric arcs thereacross while the piston 15 does not engage the step **28*b* due to the low strength of the helical spring 20 (see FIG. 25**).

Therefore, when the pressure of the fluid within the reservoir 30 is increased by expanding the same by the utilization of the electric arc struck upon interrupting the particular current, the temperature rise in the reservoir is limited by the partition defining the boundary between the reservoir and the space where the electric arc strikes. This results in an increase in arc-extinguishing ability.

Figure 26:
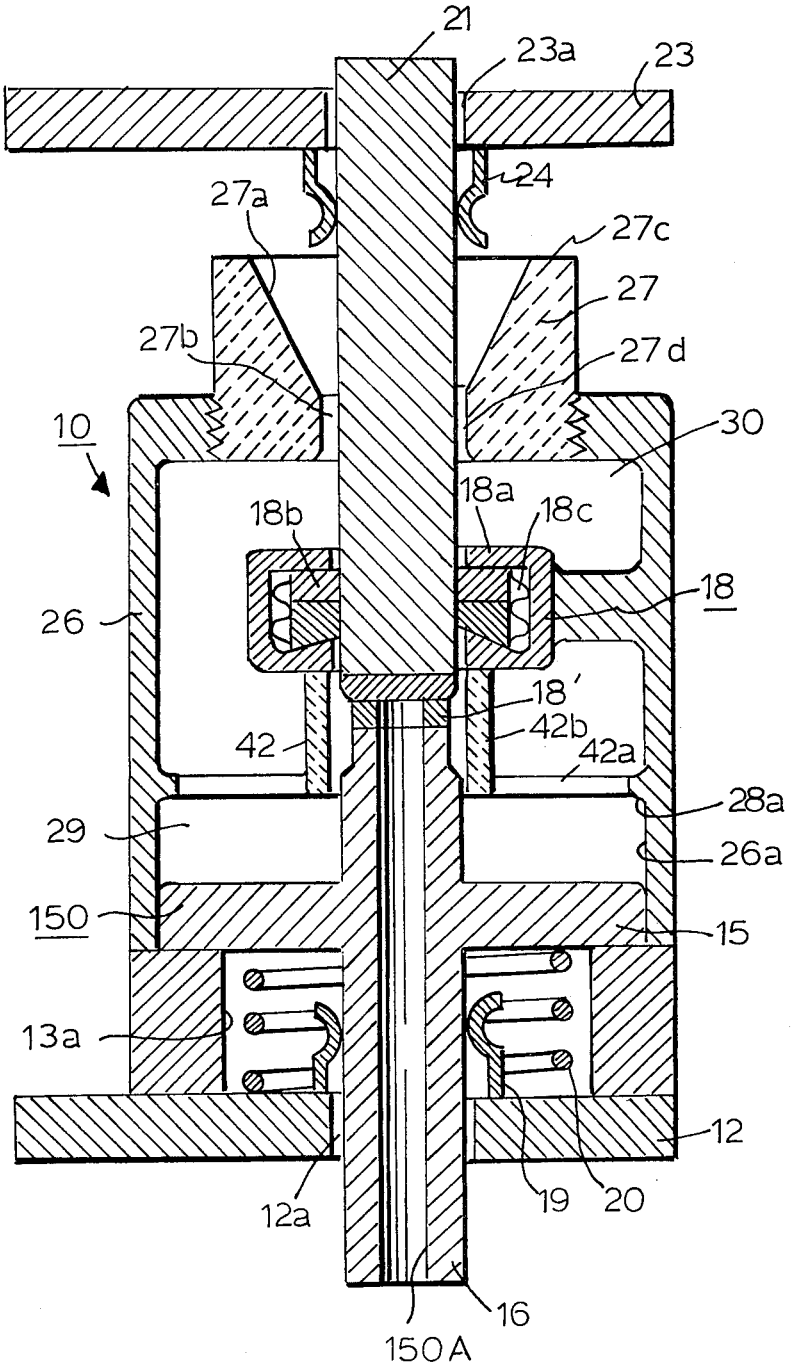
FIG. 26 is a view similar to FIG. 23 but illustrating a modification of the arrangement as shown in FIGS. 23, 24 and 25 applied to the arrangement shown in FIGS. 7 and 8.

The arrangement illustrated in FIG. 26 is different from that shown in FIG. 22 principally in that in FIG. 26 an encircling member similar to that shown in FIG. 24 is disposed within the hollow cylindrical member 26. More specifically, the encircling member 42 is fixed to the inner wall surface of the hollow cylindrical member 26 substantially identical to that shown in FIG. 24 in the same manner as described above in conjunction with FIG. 24 excepting that sleeve **42*b* is connected to the stationary contact member 18. The sleeve 42*b* is axially aligned with the through hole in the stationary contact member 18 having a diameter slightly smaller than the inside diameter of the sleeve 42*b***.

Figure 27:
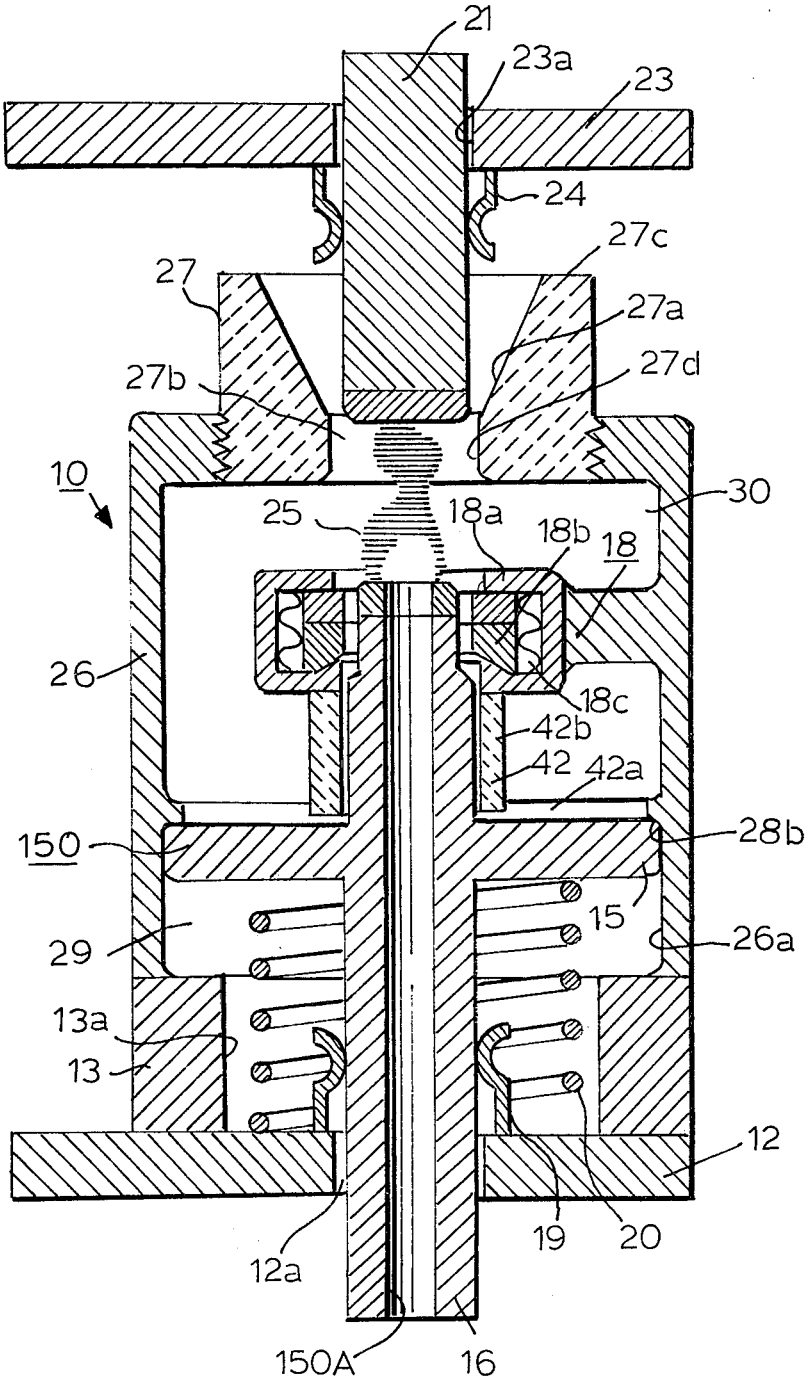
FIGS. 27 and 28 are views similar to FIG. 26 but illustrating the arrangement of FIG. 26 in different tripped positions thereof.

The slider or the arc contact member 150 has its free end portion reduced in diameter is adapted to be located within the sleeve **42*b* at the closed position as shown in FIG. 26. An electric arc 25 strikes across contact members 21 and 150 when the piston 15 abuts the step 28*b* as shown in FIG. 27. That portion of the contact member 150 inwardly of the reduced end portion has a predetermined length so as to be encircled by the sleeve 42*b***.

Figure 28:
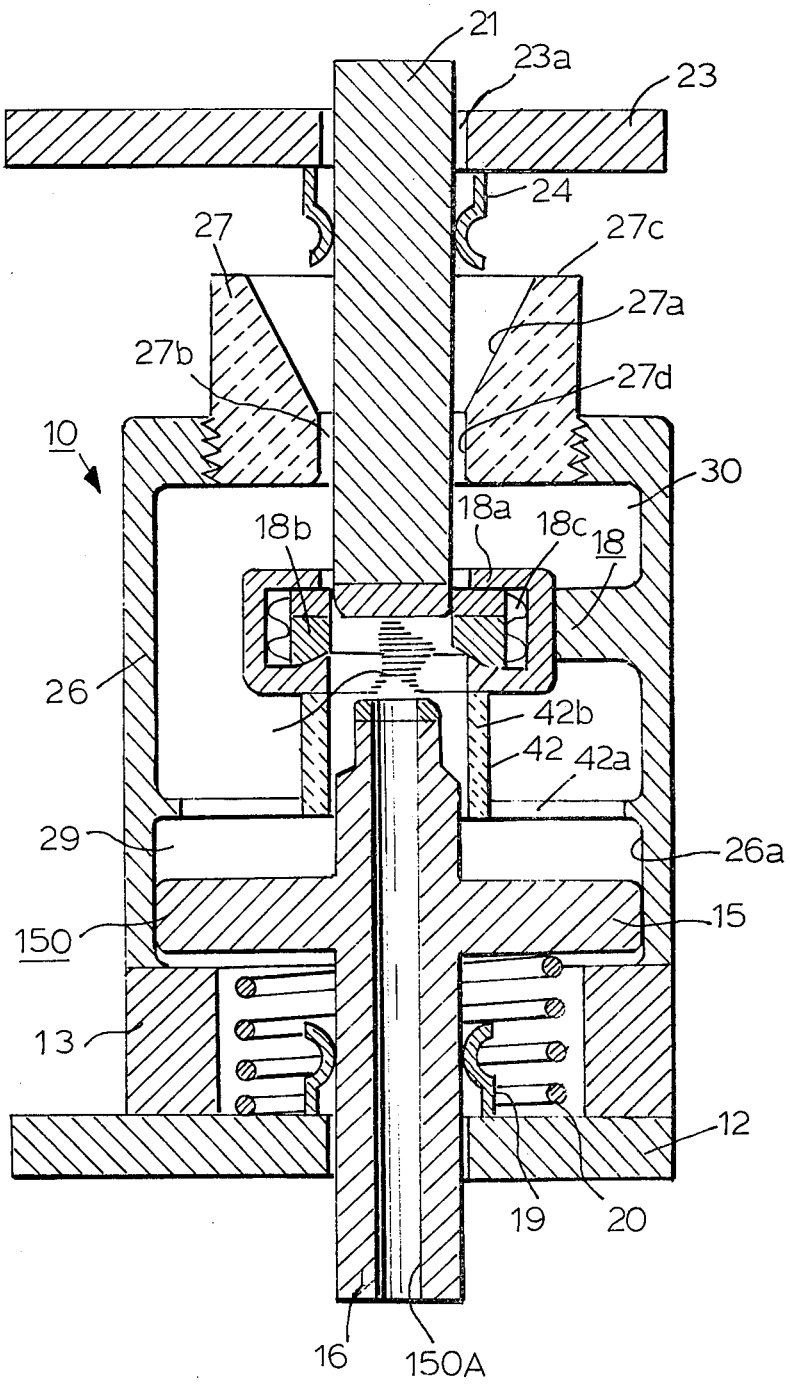

FIG. 28 shows the slider or arc contact member 15 not following the movement of the movable contact member 21 due to a weak helical spring 20. The encircling member 42 or the sleeve **42*b* plays its role in preventing the arc-extinguishing fluid in the reservoir 30 from escaping to the external space until the fluid is completely compressed within the reservoir 30 by the movement of the piston 15 and in retaining the fluid at a low temperature in the reservoir until interruption of the electric arc is completed. Of course, the fluid from the reservoir 30 is permitted to be delivered to the external space only after it has penetrated the arc and the free end of the movable contact member 21 passes through the flared portion 27*a* of the nozzle 27**.

Figure 29:
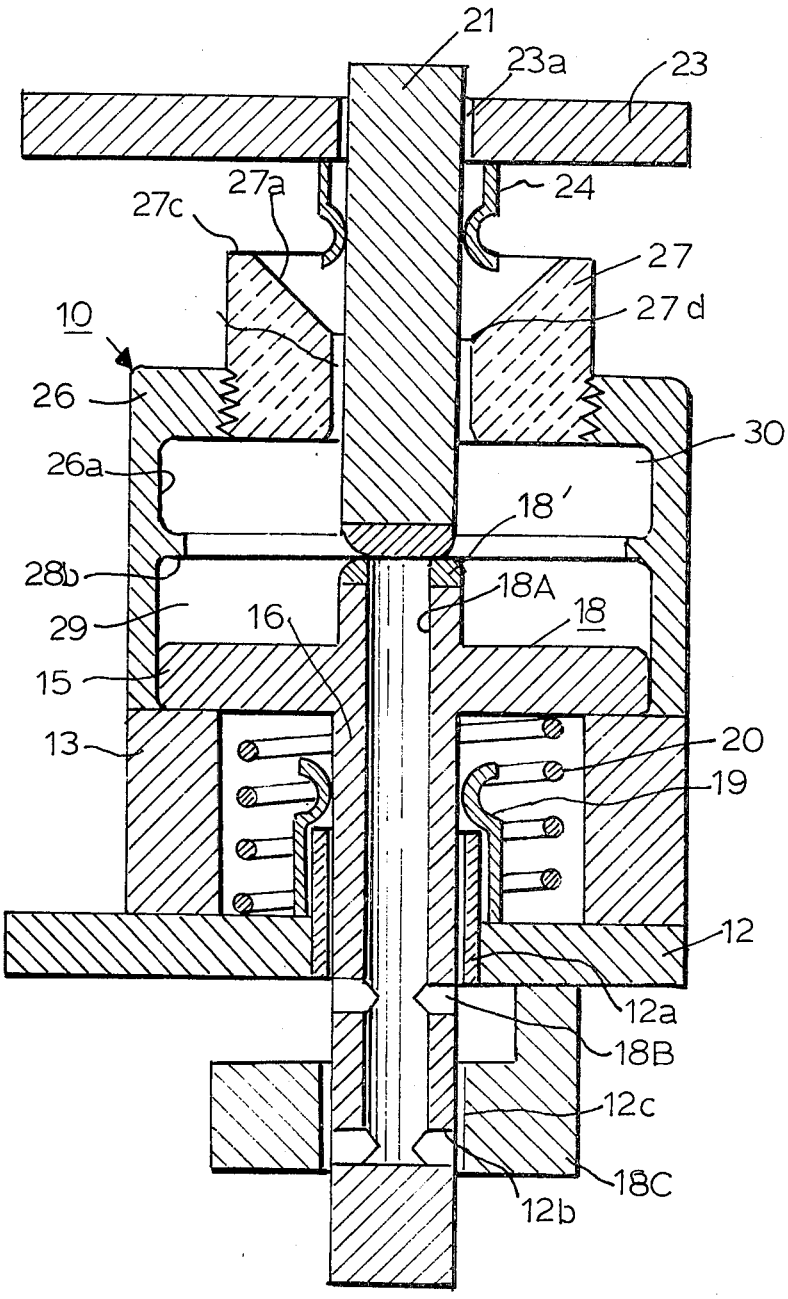
FIGS. 29 and 30 are views similar to FIGS. 20 and 21 respectively but illustrating another modification of the arrangement shown in FIGS. 20 and 21.

FIG. 29 illustrates a modification of the arrangement shown in FIG. 20. The arrangement illustrated is different from that shown in FIG. 20 only in that in FIG. 29 the axial exhaust passageway 18A extending through the stationary contact member 18 is selectively connected in fluid communication with the external space through at least two pairs of radial holes spaced at a predetermined axial distance. More specifically, the axial exhaust passageway 18A includes first plurality of radial holes 18B disposed at predetermined equal angular intervals in the stationary contact member 18 and located just under the terminal plate 12 at the closed position of the stationary contact member thereby to put the axial exhaust passageway 18A in fluid communication with the exterminal space therethrough. In FIG. 29 the pair of radial holes 18B is shown as being diametrically opposite each other. When the stationary contact member 18 is moved upward as viewed in FIG. 29, the radial holes 18B are closed by a sleeve **12*b* tightly fitted into the opening 12*a* on the terminal plate 12 and extending toward the puffer piston 15 with a small clearance between the sleeve 12*a* and the stationary contact member 18. Therefore the axial exhaust passageway 18A** is prevented from communicating with the external space.

Figure 30:
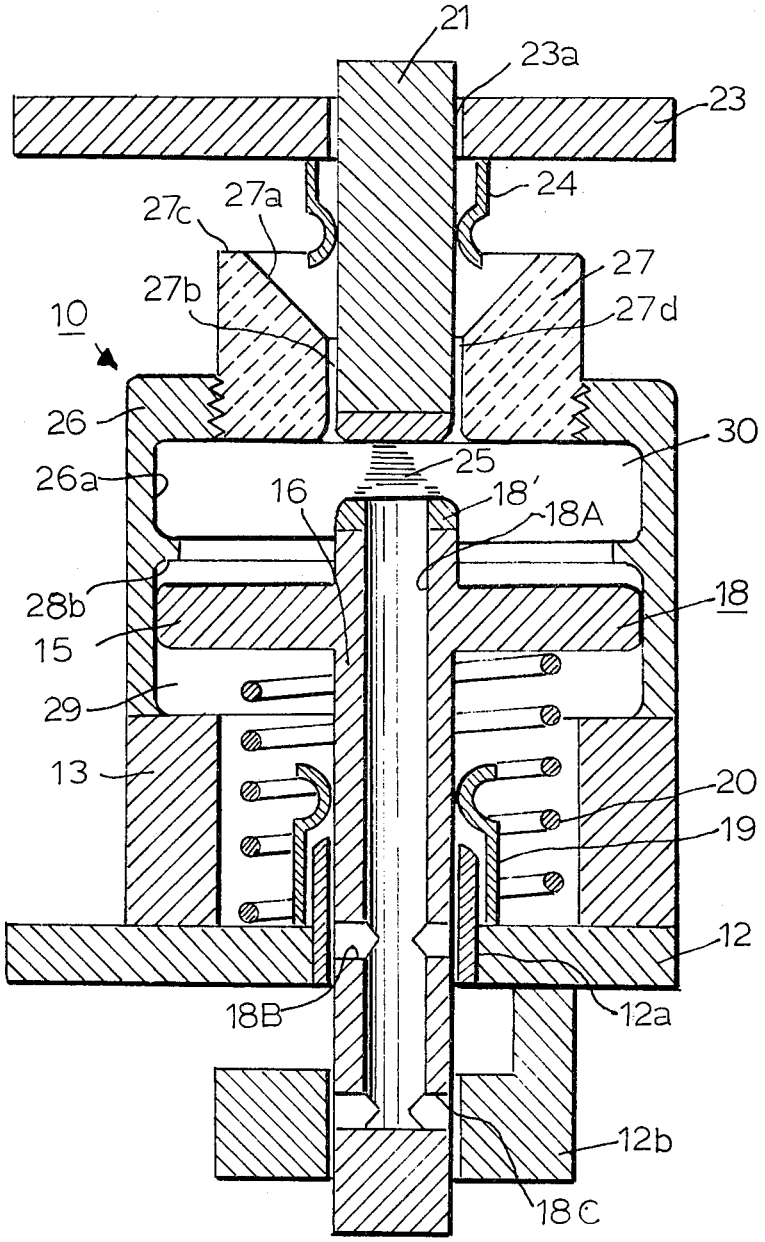

On the other hand, when the stationary contact member 18 is moved upward and then stopped by the engagement of the puffer piston 15 with the step **28*b*, the axial passageway 18A is arranged to communicate with the external space through a second plurality of radial holes 18C disposed in the contact member 18 in the same manner as the radial holes 18B. To this end, the second pair of radial holes 18C are located below the first plurality of radial holes 18B at a predetermined distance substantially equal to the axial length of the compression chamber 29 shown in this case as being equal in diameter to the reservoir 30. An L-shaped closure block 12*b* is pendent from the terminal plate 12 so that one leg of the "L" is parallel to the latter. That leg is provided with a through opening 12*c* axially aligned with the sleeve 12*a* through which the stationary contact member movably extends. In the closed position of the stationary contact member 18, the second radial holes 18C face the opening 12*c* adjacent to the bottom of the closure block 12*b* so as to be prevented from communicating with the external space as shown in FIG. 29 wherein contact members 18 and 21 are illustrated as being in the closed position. That is, the axial exhaust passageway 18A is not connected in fluid communication with the external space. The opening 12*c* has an axial length dimensioned so that, when the puffer piston 15 does not engage the step 28*b* as shown in FIG. 30, the second radial holes 18C face the opening 12*c* to prevent the axial exhaust passageway 18A** from communicating with the external space.

The axial exhaust passageway 18A terminates at the same level as the lowermost wall of the second radial holes 18C.

In the interrupting operation the movable contact member 21 is separated from the stationary contact member 18 to strike an electric arc 25 thereacross within the reservoir 30. At that time the reservoir 30 communicates with the external space through the axial exhaust passageway 18A and the second radial holes 18C. If an electric arc strikes across contact members 18 and 21 while the former does not follow the latter up as shown in FIG. 30 then the reservoir 30 does not communicate with the external space and instead the fluid pressure is accumulated within the reservoir 30 until the puffer piston 15 engages the step **28*b*. Under these circumstances, if excessive fluid pressure is accumulated within the reservoir 30 due to a high arc current then the stationary contact member 18 is moved away from the movable contact member 21 to reach its lowermost position as viewed in FIG. 29. In this case, the pressure within the reservoir 30 is released through the axial exhaust passageway 18A and the first radial holes 18B**.

In the arrangement of FIG. 29, the electric arc struck upon the separation of the contact members is also utilized to expand the fluid within the reservoir to raise the fluid pressure therein after which the fluid from the reservoir is rapidly delivered thereby to cool and extinguish the electric arc. In addition, the first and second radial holes are responsive to the movement of the stationary contact member to communicate and block the reservoir with and against the external space. This prevents a rise in temperature in the reservoir yet permits sufficient fluid pressure to be accumulated therein. Therefore the interrupting performance can be improved. Also the resilience exerted on the stationary contact member can be reduced and the force for driving the movable contact member may be low and the construction is simplified.

Figure 31:
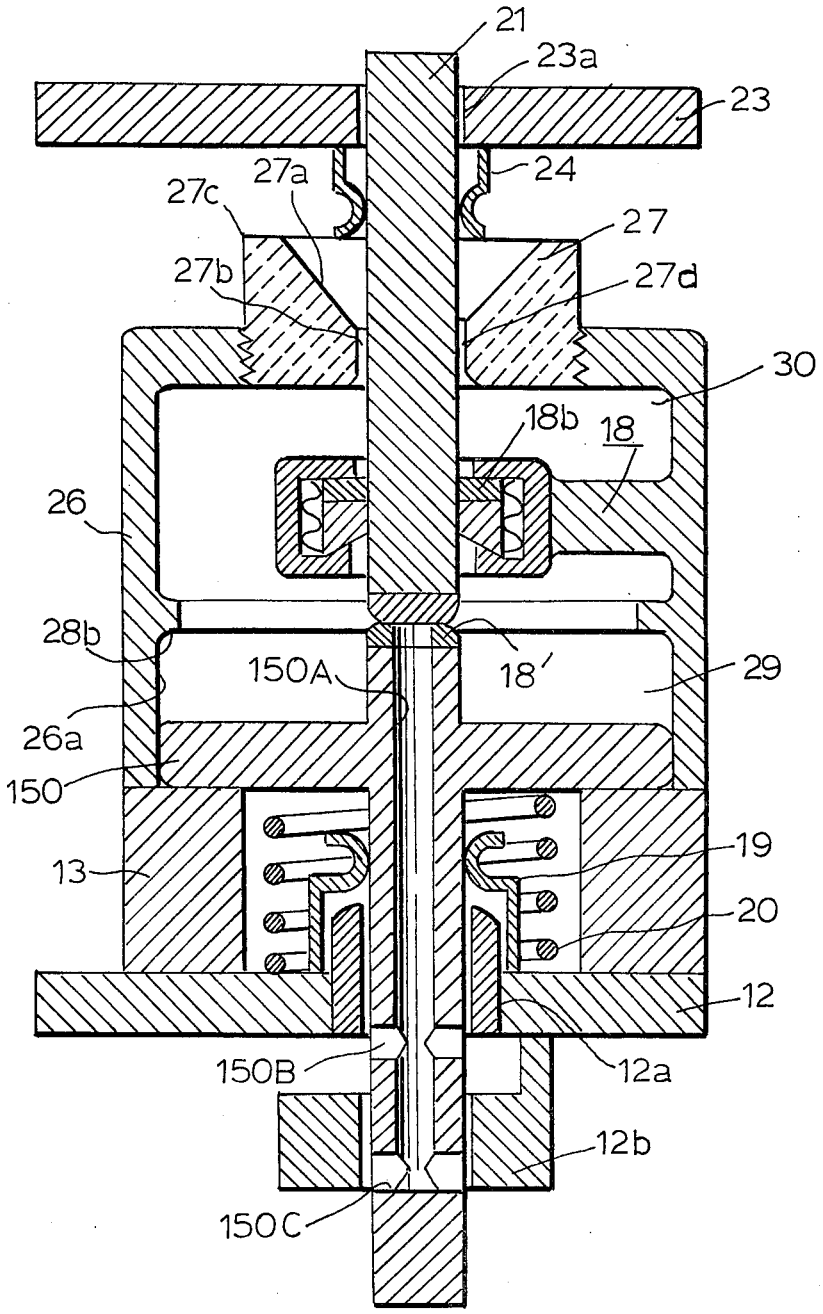
FIG. 31 is a view similar to FIG. 22 but illustrating a modification of the arrangement as shown in FIG. 22 in its closed position.

The arrangement of FIG. 22 can be modified in the same manner as described above in conjunction with FIGS. 28 and 29 resulting in that illustrated in FIG. 31. In the arrangement illustrated, the slider 150 also serving as the arc contact member is identical in construction to the stationary contact member 18 shown in FIGS. 28, 29 and 30 and can be substituted for the latter. Therefore the axial passageway 150A, first radial holes 150B and second radial holes 150C correspond to the axial passageway 18A, the first radial holes 18B and the second radial holes 18C as shown in FIGS. 28 and 29 respectively.

Figure 32:
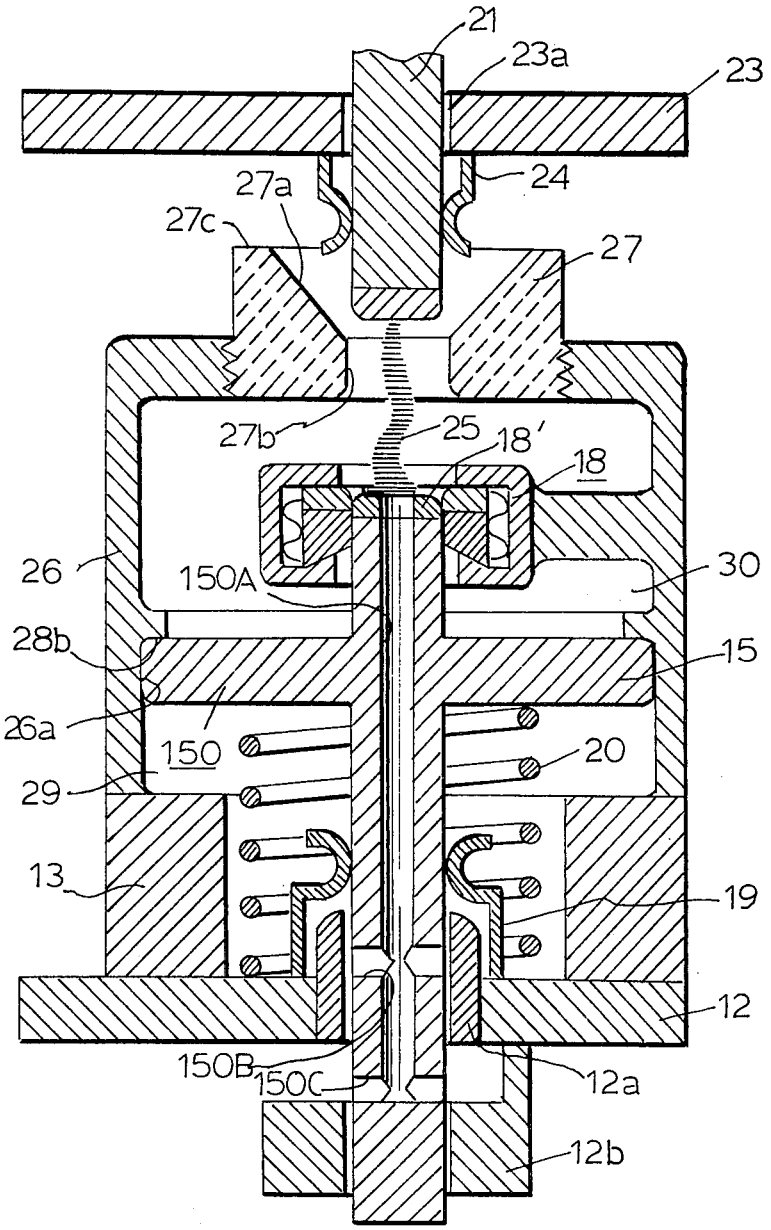
FIGS. 32 and 33 are views similar to FIG. 31 but illustrating the arrangement of FIG. 31 in different tripped positions thereof.
Figure 33:
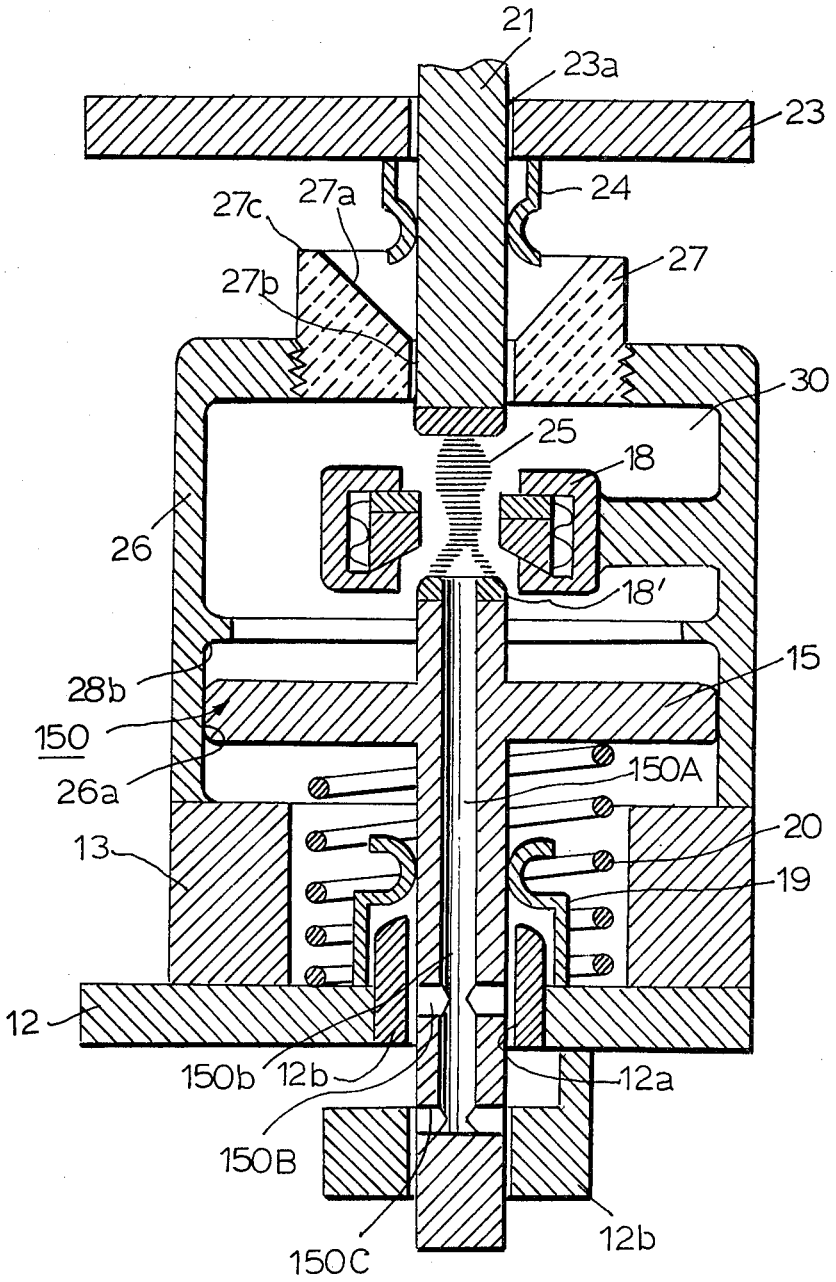

Also FIGS. 31 and 32 show the arrangement in its closed and tripped positions while FIG. 33 corresponds to FIG. 30.

Figure 34:
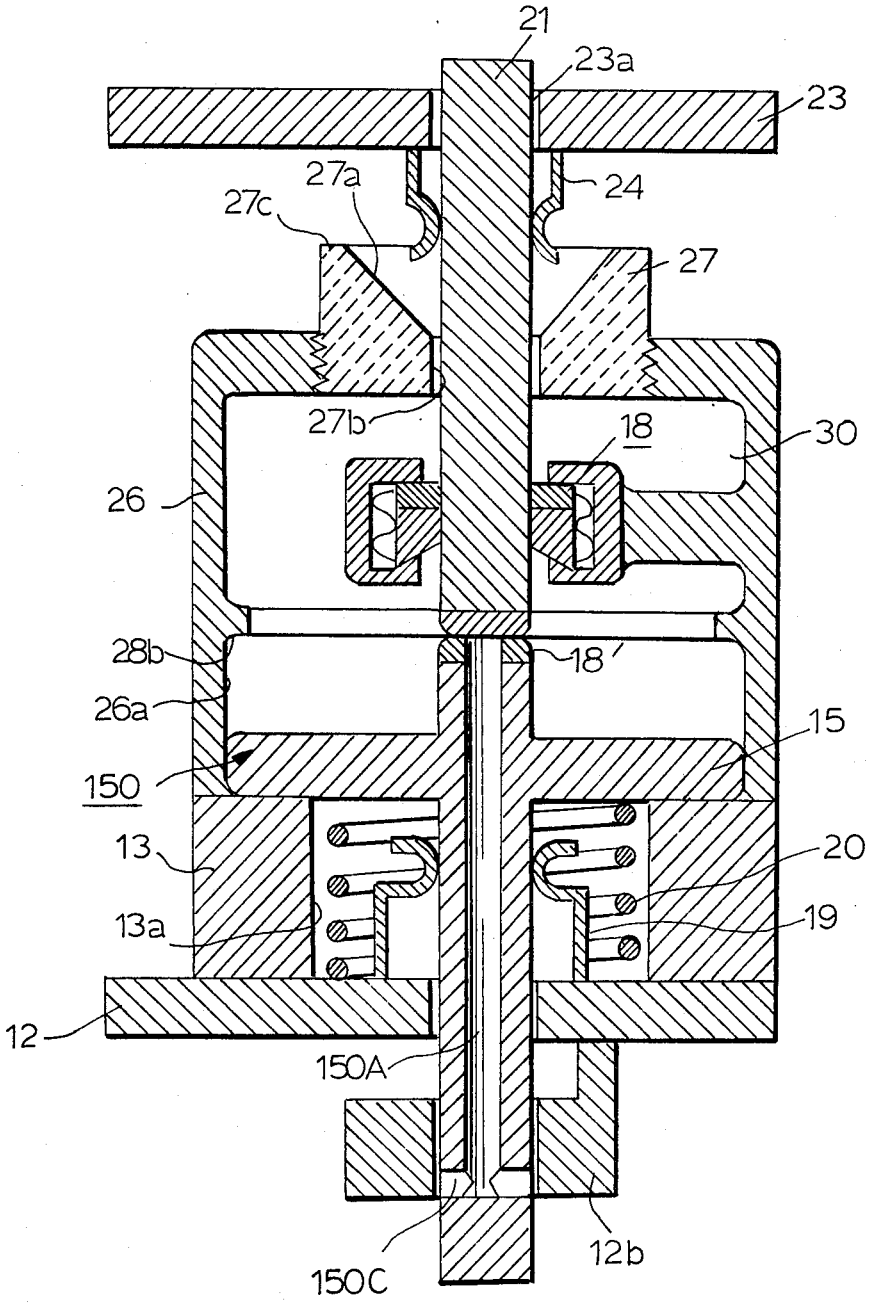
FIGS. 34 and 35 are views similar to FIG. 31 but illustrating different modifications of the arrangement of FIG. 31 in their closed position.
Figure 35:
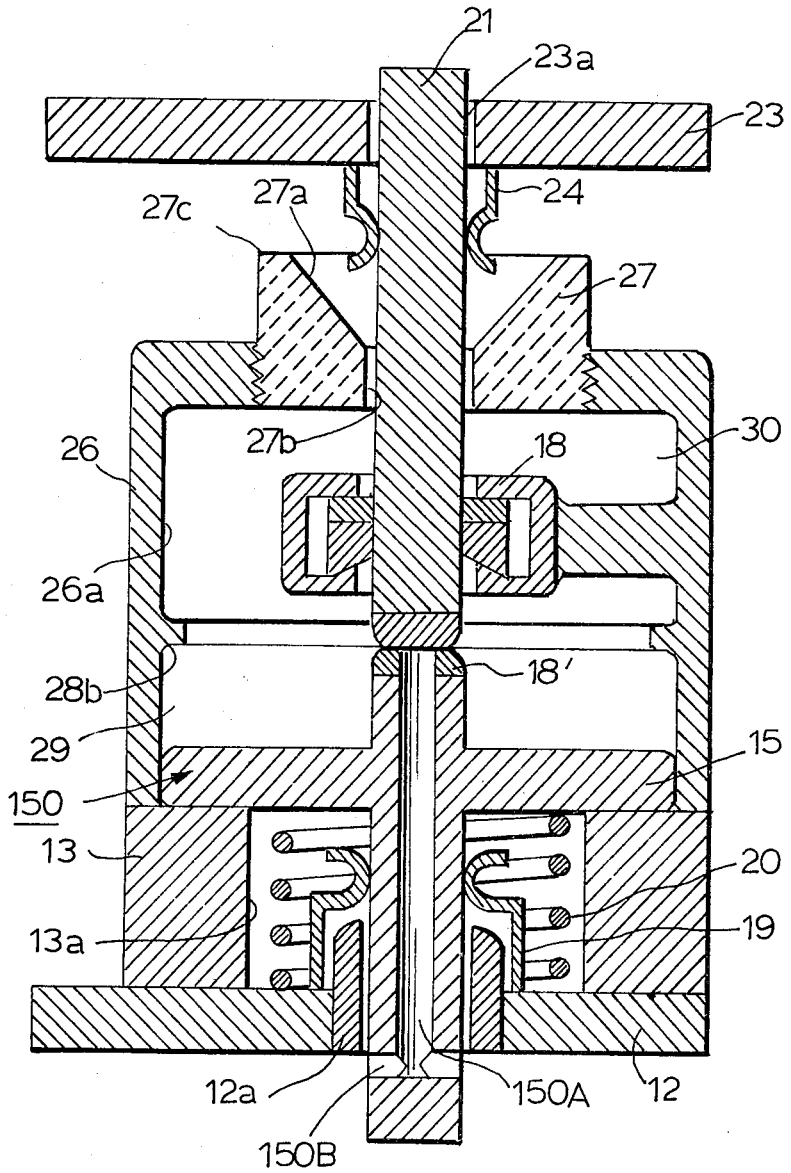

FIGS. 34 and 35 show two modifications of the arrangement illustrated in FIGS. 31 and 32. FIG. 34 shows the arc contact member 150 including only the second radial holes 150C and FIG. 35 shows the arc contact member 150 including only the first radial holes 150B and the closure block **12*b*** is omitted.

The first radial hole 18B or 150B cooperate with the sleeve **12*b* to serve as a release valve for releasing pressure in response to a large rise of pressure in the reservoir. On the other hand, the second radial holes 18C or 150C cooperate with the sleeve 12*b*** to control the operation of an exhaust opening at will in accordance with the movement of a movable member, which opening exhausts only fluid at an increased pressure due to an elevated temperature.

Figure 36:
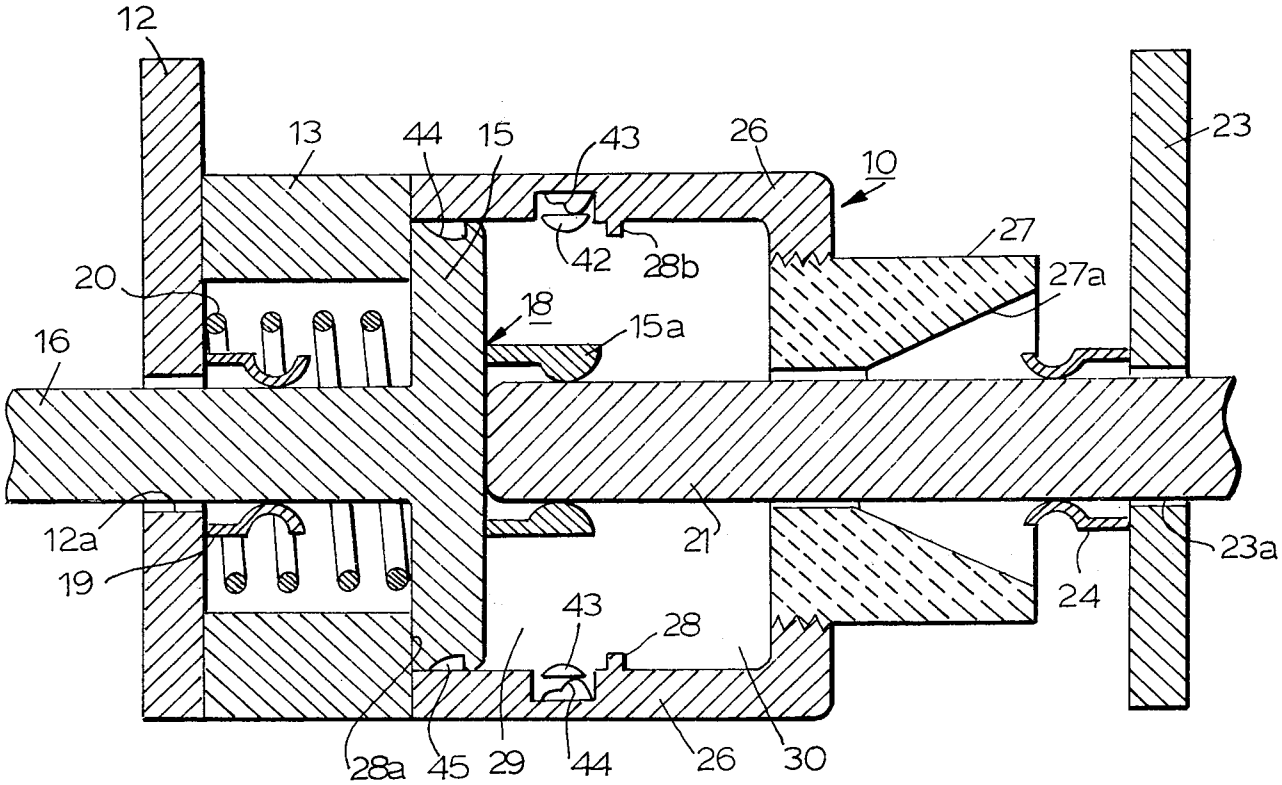
FIG. 36 is a view similar to FIG. 23 but illustrating still another modification of the present invention.

FIG. 36 shows still another modification of the present invention. The arrangement illustrated is substantially similar to that shown in FIGS. 5 and 6 excepting that in FIG. 36 there is provided latching means for holding the puffer piston in its position where the piston has completed compressing the arc-extinguishing fluid in the compression chamber and therefore in the reservoir. More specifically, the latching means includes a plurality of latches 43 disposed at predetermined equal angular intervals on the inner wall surface of the compression chamber 29 adjacent to the circumferential step **28*b* which is formed of a radially inward directed rib defining a boundary between the compression chamber 29 and reservoir 30 equal in diameter to each other. To this end, a plurality of recesses are provided in the inner wall surface of the compression chamber 29 at positions coinciding with those of latches 43 and the latches 43 are disposed in the respective recesses on leaf springs 44 interposed between the same and the bottoms of the recesses. Therefore each of the latches 43 tends to be normally forced radially inward by means of the action of the mating leaf spring 44 so that it normally protrudes in the radially inward direction from the inner wall surface of the compression chamber 29**.

The latching means also includes a circumferential groove 45 disposed on the peripheral surface of the piston 15 at such a position that, when the piston 15 engages the step **28*b*, the groove 45 faces the latches 43. As the groove 45 is complementary in shape to each latch 43, they are fitted into the groove 44 and resiliently held in engagement with the latter. The latches 45 and therefore the groove 45 are so shaped that the resilience of the helical spring 20 can easily place the groove 45 in engagement with the latches 43 while groove 45 can not disengage from the latches 43 unless a force greater than the resilience of the helical spring 20 is applied to the groove 45**.

As shown in FIG. 36, a receptable 15*a* in the form of a hollow cylinder is fixedly secured to the flat surface of the piston 15 facing the reservoir 30 at the center. The receptacle 15*a* includes a contracted portion near its mouth to permit the free end portion of the movable contact member 21 to be forced thereinto. The receptacle 15*a* acts as a contact attached to the stationary contact member 18.

Figure 37:
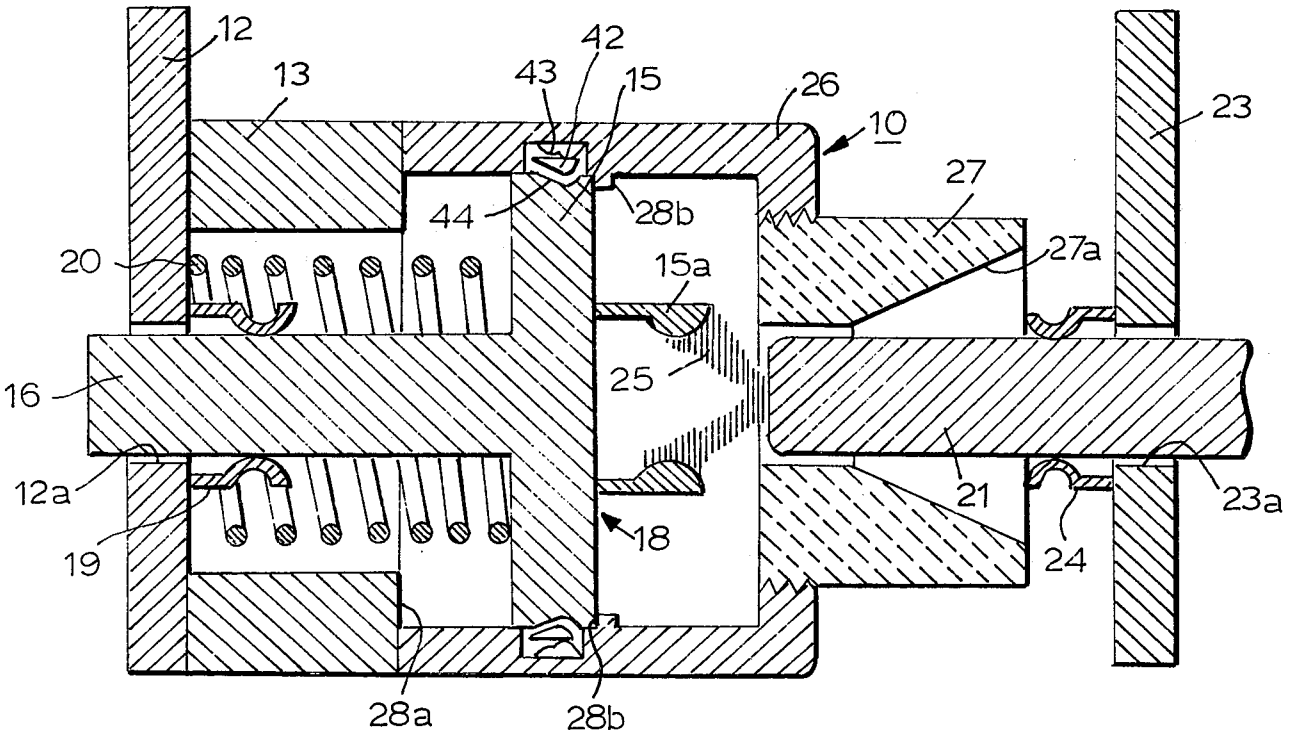
FIG. 37 is a view similar to FIG. 36 but illustrating the arrangement of FIG. 36 in its tripped position.

In the interrupting operation, the puffer piston 15 engages the step 28*b* so as to be prevented from being further moved while at the same time the groove 45 on the piston 15 engages the latches 43 on the inner wall surface of the compression chamber. Then the movable contact member 21 disengages from the receptacle 15*a* to strike an electric arc 25 thereacross as shown in FIG. 37. The electric arc 25 causes the fluid pressure in the reservoir 30 to be further increased thereby to increase the force tending to force the stationary contact member 18 in the leftward direction as viewed in FIG. 37. However, even though this force is higher than the resilience of the helical spring 20, the stationary contact member 18 is prevented from being moved leftward as viewed in FIG. 37 because the groove 45 is in engagement with the latches 43 to hold the stationary contact member 18 fixed to the hollow cylindrical member 26. Therefore the reservoir 30 can be maintained under a high fluid pressure.

When the fluid pressure in the reservoir 30 increases beyond a fluid pressure sufficient to extinguish the electric arc, the groove 45 disengages from the latches 43 to move the stationary contact member 18 toward its original position against the resilience of the helical spring 20. This prevents the fluid pressure in the reservoir 30 from increasing excessively. Upon the fluid pressure within the reservoir 30 falling, the stationary contact member 18 is again moved rightward until it is again locked by the latching means 43, 44, 45.

Thereafter the movable member 21 is further separated from the stationary contact member resulting in the extinction of the electric arc as described above.

When the movable contact member 21 at its open position is moved to engage the contacts 15*a* on the stationary contact member 18, a current immediately flows through both contact members to generate an electromagnetic repulsion therebetween. Under these circumstances, the groove 45 on the piston 15 is in engagement with the latches 43 to prevent the stationary contact member 18 from moving leftward as viewed in FIG. 37. Accordingly, the contact members are not separated from each other so that no electric arc strikes thereacross. Accordingly the movable contact member 21 and the contact 15*a* on the stationary contact member 18 are prevented from fusing to each other due to an electric arc struck thereacross.

Then the free end of the movable contact member 21 is forced into the receptacle 15*a* after which the movable contact member 21 is pushed in the leftward direction as viewed in FIG. 37. This causes the groove 45 to disengage from the latches 43 thereby to permit the moved components to be returned to their original positions as shown in FIG. 36.

While the stationary contact member 18 is formed integrally with the piston 15, it is to be understood that, as shown in FIG. 7, the stationary contact member 18 in the form of a split contact may be an annulus and disposed in the reservoir 30 and slidably engage the outer peripheral surface of the movable contact member. Further the latching means is not required to be disposed on both the piston 15 and the compression chamber 29 but it may be disposed on the guide rod for the piston 15 and that portion of the terminal plate 12 slidably engaged thereby.

In the arrangement shown in FIGS. 36 and 37, the puffer piston can be held in its position where the piston has just completed compressing the arc-extinguishing fluid. Therefore the piston is prevented from retrograding forcedly resulting in improvements in the interrupting performance. In addition, the contact members during the closing process are prevented from being again separated from each other due to electromagnetic repulsion generated therebetween resulting in an increase in current capacity. Therefore, the resulting device is small-sized inexpensive and has a high in current capacity as compared with the prior art practice.

Figure 38:
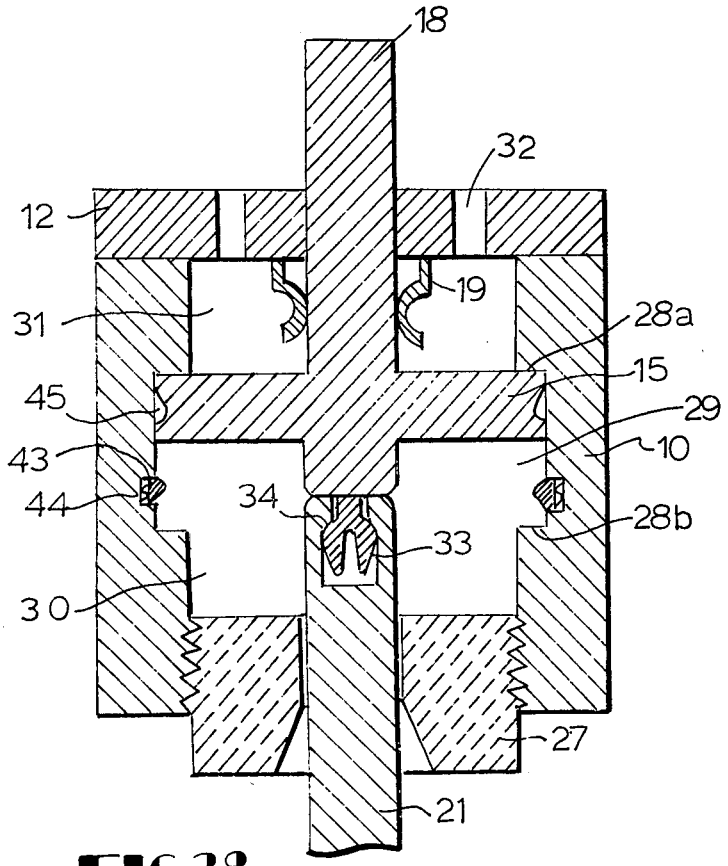
FIG. 38 is a view similar to FIG. 9 but illustrating at its closed position a modification of the arrangement as shown in FIGS. 36 and 37 applied to the arrangement shown in FIGS. 9 and 10.

The arrangement illustrated in FIG. 38 is different from that shown in FIG. 9 only in that in FIG. 38 latching means including latches 43, leaf springs 44 and a groove 45 is disposed in the same manner as described above in conjunction and FIG. 36 with the receptacle 15*a* is omitted.

Figure 39:
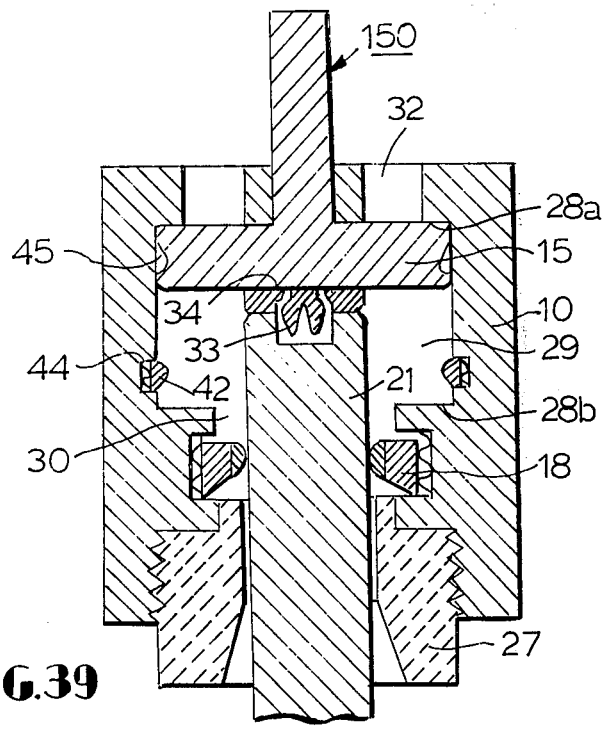
FIG. 39 is a view similar to FIG. 17 but illustrating in its closed position another modification of the arrangement of FIG. 38 applied to the arrangement shown in FIGS. 17 and 18.

The arrangement illustrated in FIG. 39 is different from that shown in FIG. 17 only in the same respect just described in conjunction with FIG. 38.

Figure 40:
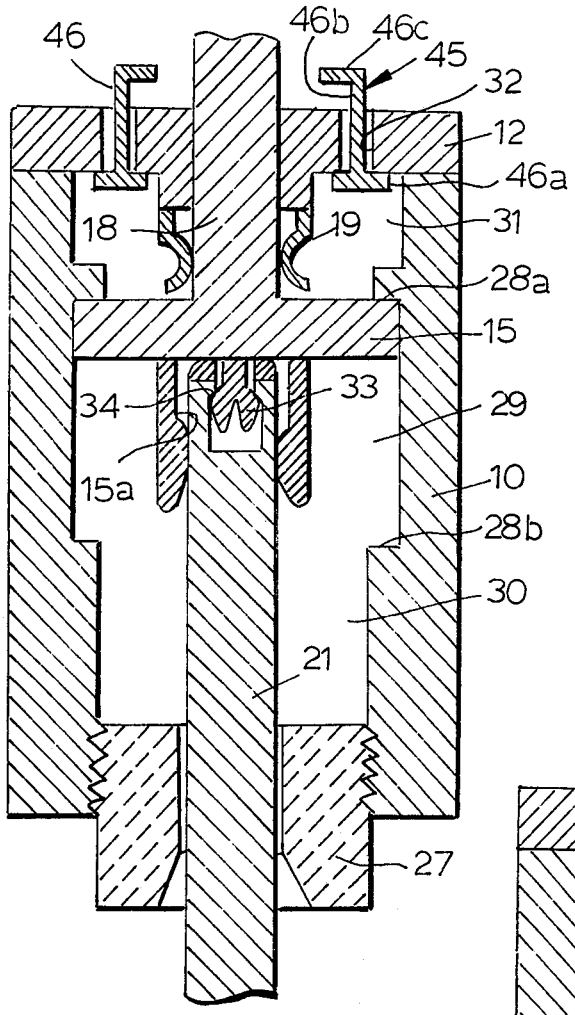
FIG. 40 is a view similar to FIG. 9 but illustrating in its closed position another modification of the arrangement shown in FIGS. 9 and 10.

The arrangement illustrated in FIG. 40 is different from that shown in FIG. 9 principally in that in FIG. 40, a check valve is operatively coupled to each of the through holes in the terminal plate through which the stationary contact member slidably extends. As shown in FIG. 40, the check valve designated by the reference numeral 46 includes a valve body 46*a* normally closing an open end of an associated one of the through holes 32 in the terminal plate 12 facing the chamber 31, now called a "back pressure chamber", and a valve stem 46*b* connect at one end to the valve body 46*a* and extending loosely through the associated hole 32 and having the other end portion protruding beyond the terminal plate 12. The other end portion is folded into a "L" forming a stop 46*c* for preventing the check valve from falling into the back pressure chamber 31.

Also a receptacle 15*a* such as shown in FIG. 36 is fixedly secured to the puffer piston 15 in the same manner as described above in conjunction with FIG. 36.

In other respects the arrangement is identical to that shown in FIG. 9.

When the movable contact member 21 is descending with the stationary contact member 18 to compress the arc-extinguishing fluid in both the compression chamber 29 and the reservoir 30, the check valves 46 open the associated through holes 32 due to a pressure difference between the external space and the back pressure chamber 31. Therefore the fluid pressure in the back pressure chamber 31 does not impede the descent of the piston 15 and the other structure.

Figure 41:
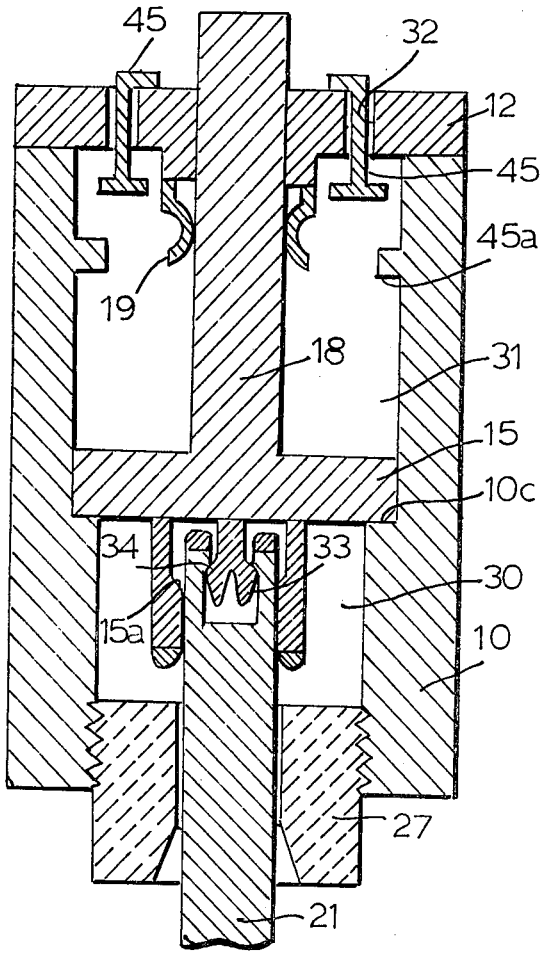
FIGS. 41 and 42 are views similar to FIG. 40 but illustrating the arrangement of FIG. 40 in different tripped positions thereof.

Then the piston 15 abuts against the step 28*b* as shown in FIG. 41 until the recess 34 on the movable contact member 21 disengages from the tulip-shaped member 33, in this case, formed of an electrically insulating material. Also the movable contact member 21 is separated from the stationary contact member 18 resulting in an electric arc striking thereacross. This electric arc acts to increase the fluid pressure in the reservoir 30 further until the piston 15 is forced to retreat. This results in the closure of the check valves 46. Therefore the fluid pressure in the back pressure chamber 31 increases to suppress the retreat of the piston 15. As a result, the reservoir 30 is maintained under a high fluid pressure.

Figure 42:
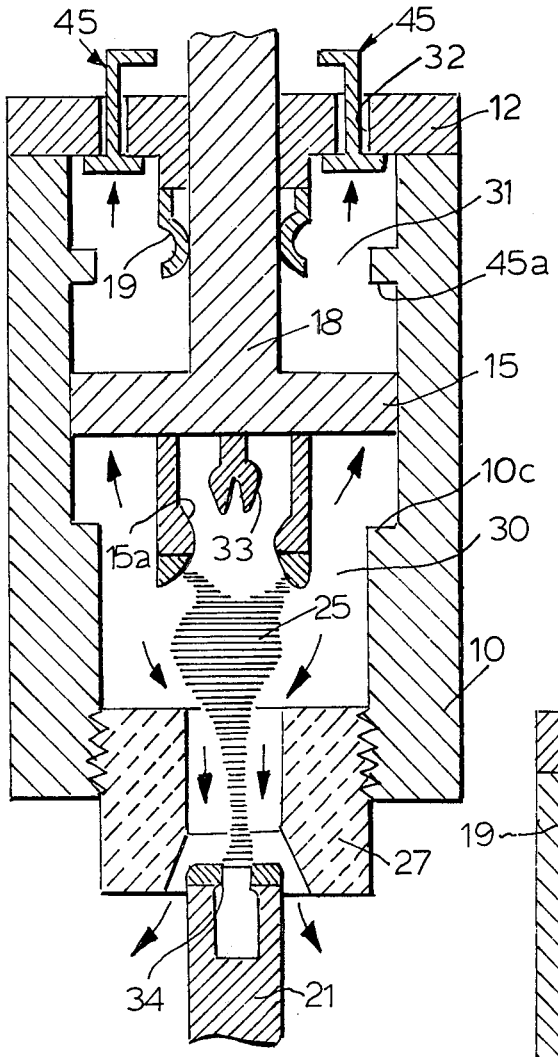

Thereafter the movable contact member 21 reaches the position illustrated in FIG. 42, and then the electric arc 25 is blown out with a stream of the arc-extinguishing fluid designated by the arrows beside the electric arc 25. As shown also in FIG. 42, the electric arc 25 spreads across the ends of contact members 21 and 18 so that the tulip-shaped member 33 is prevented from being directly exposed to the electric arc 25.

From the foregoing it is seen that the check valves are provided to suppress the retreat of the piston. Therefore it is possible to perform the puffer action more effectively resulting in improvements in interrupting performance.

Figure 43:
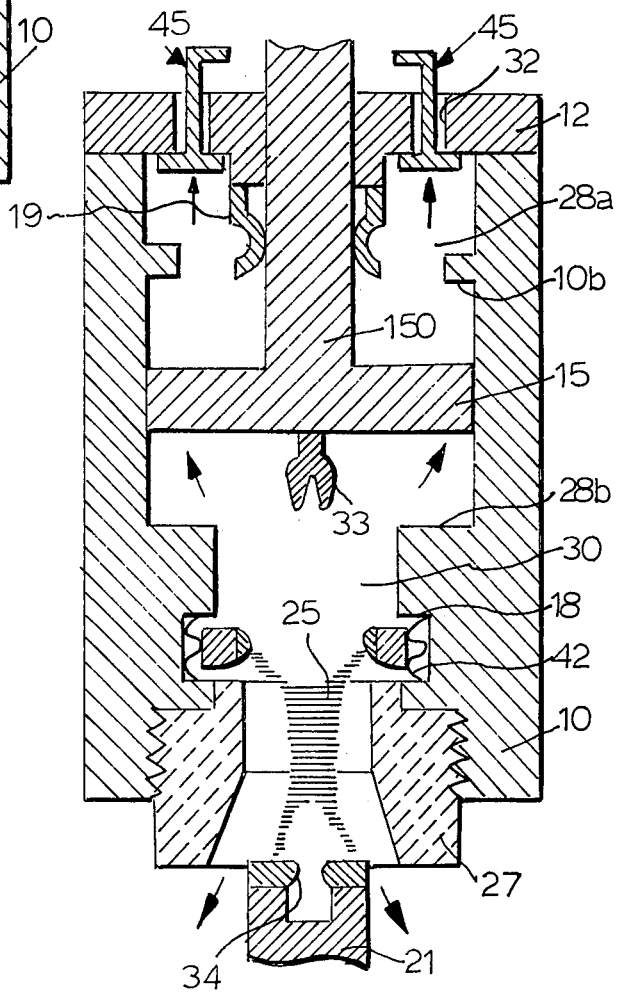
FIG. 43 is a view similar to FIG. 40 but illustrating in its tripped position a modification of the arrangement shown in FIGS. 40, 41 and 42.

The arrangement illustrated in FIG. 43 is different from that shown in FIGS. 40, 41 and 42 only in that in FIG. 43 a pair of stationary contact members are disposed in diametrically opposite relationship within the reservoir while the stationary contact member 18 shown in FIGS. 40, 41 and 42 serves as a slider or arc contact member and the receptacle 15*a* on the piston 15 being omitted. In the arrangement illustrated a pair of recesses are disposed in diametrically opposite relationship on the inner wall surface of the reservoir 30 and have inserted thereinto respective stationary contact members 18. The stationary contact members 18 tend to be moved radially inwardly by means of the action of mating leaf springs 42 interposed between the same and the bottoms of the associated recesses. Therefore both stationary contact members 18 are arranged to engage slidably the outer peripheral surface of the movable contact member 21.

Figure 44:
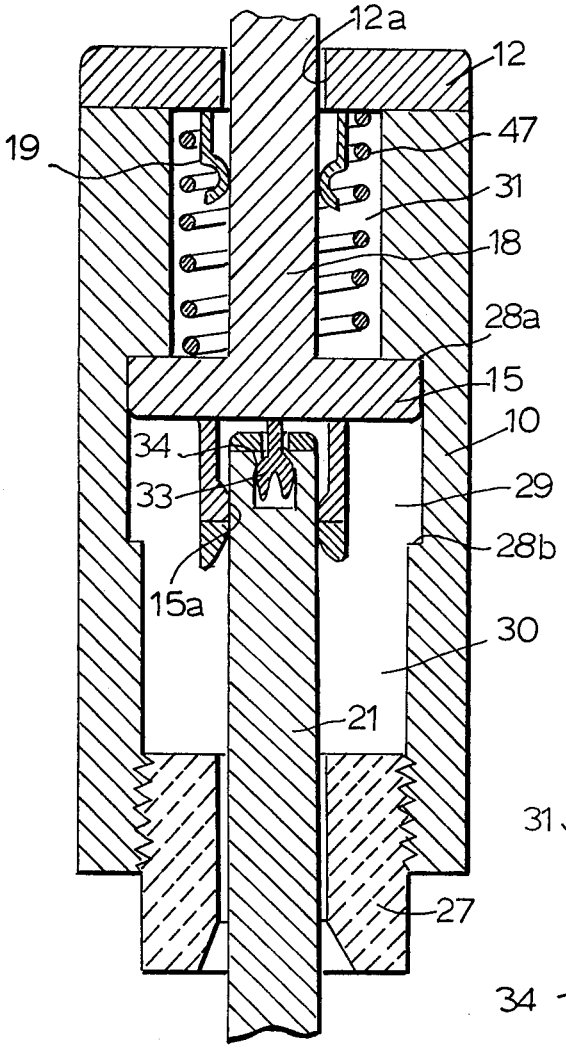
FIGS. 44 and 45 are views similar to FIG. 9 but illustrating in their closed position different embodiment of the arrangement shown in FIGS. 9 and 10.

The arrangement illustrated in FIG. 44 is different from that shown in FIGS. 41, 42 and 43 only in that in FIG. 44 a tension spring 47 is disposed around the stationary contact member 18 between the puffer piston 15 and the terminal plate 12 and has both ends suitably fixed to the respective members, and the check valves 46 and the through holes 32 are omitted. The tension spring 47 serves to hold the piston 15 and therefore the stationary contact member 18 in the inoperative position illustrated in FIG. 44.

The piston 15 along with the stationary contact member 78 and the movable contact member 21 is moved downward as viewed in FIG. 44 against a tension provided by the tension spring 47 to compress the arc-extinguishing fluid in both the compression chamber 29 and the reservoir 30 after which an electric arc struck cross the movable contact member 21 and the receptacle or the contact 15*a* on the stationary contact member 18 is extinguished as described above.

It is noted that, after the tulip-shaped member 33 on the stationary contact member 18 has disengaged from the recess 34 on the movable contact member 21, the puffer piston 15 receives not only the tension of the tension spring 47 but also the pressure due to the arc-extinguishing fluid being compressed by the piston 15, and thereby tends to be returned to the terminal plate 12. However, since the puffer piston 15 has a null initial speed at the beginning of this return and the tension spring 47 is required only to provide a low tension, the piston 15 is forced to be moved toward the terminal plate 12 a very small distance until the electric arc is extinguished.

Accordingly, an increase in volume of the reservoir 30 results in the fluid pressure therein and hence the amount of the fluid blowing against the electric arc being reduced to only a substantially negligible extent.

It will readily be understood that the tension spring 47 aids in returning the piston 15 to its inoperative position.

While an electromagnetic repulsion is generated between the movable and stationary contact arms 21 and 18 upon the two engaging each other, this will not move the stationary contact member 18 toward the terminal plate 12 because the piston 15 is in engagement with the step 28*a*. Therefore the stationary contact member 18 can not be separated from the movable contact member 21. This prevents an electric arc from striking across the contact members. Accordingly, the contact members are not fused to each other with the result that the tulip-shaped member 33 is permitted to be smoothly inserted into the recess 34.

Figure 45:
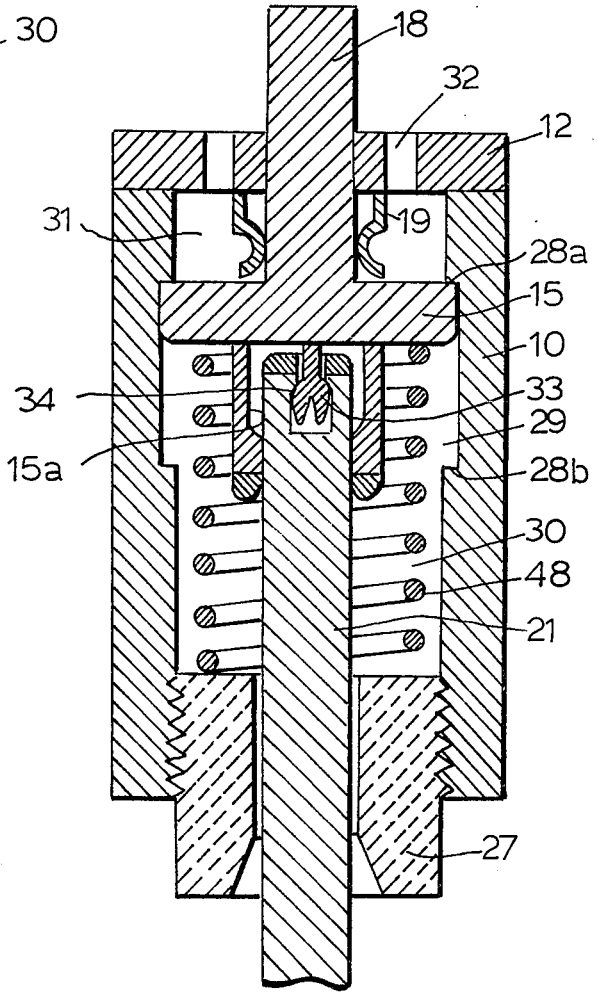

While the arrangement of FIG. 44 utilizes the tension of the tension spring, a helical spring 48 may be disposed around the movable contact member 21 at its closed position and extending through both the compression chamber 29 and the reservoir 30 as shown in FIG. 45. In the latter case, the resilience provided by the helical spring 48 is utilized for the same purpose as the tension of the tension spring 47.

Figure 46:
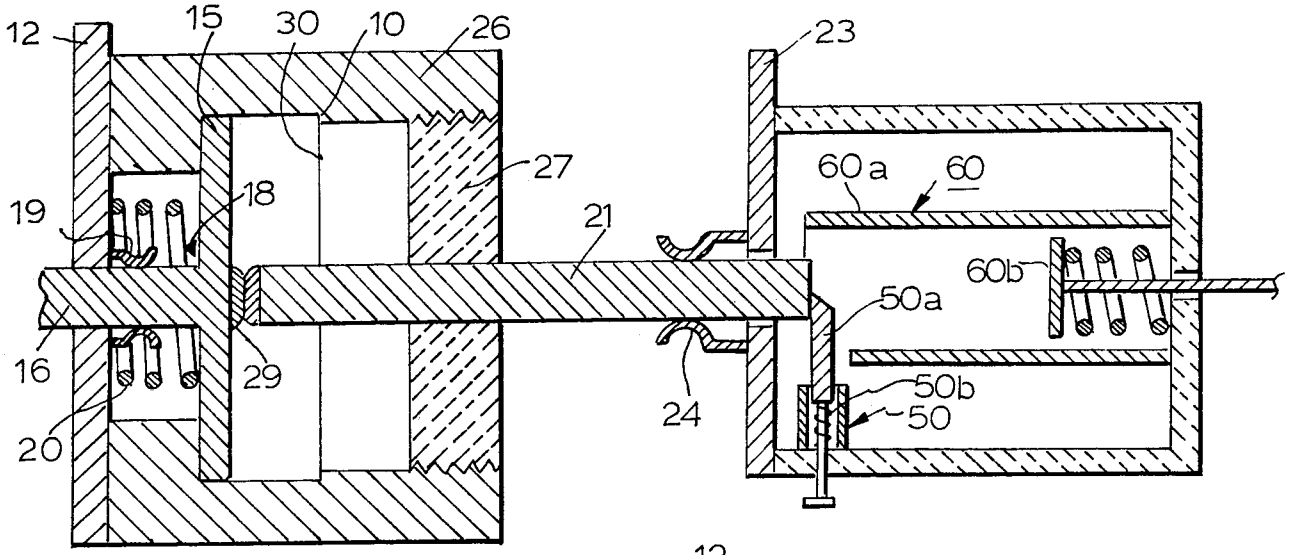
FIG. 46 is a longitudinal sectional view of a different modification of the present invention illustrated in its closed position with parts omitted.

FIG. 46 shows a different embodiment of the present invention. In FIG. 46, the arrangement similar to that shown in FIGS. 5 and 6 includes the terminal plate 23 closing one end of an enclosure 49 and the movable contact member 21 in its closed position is engaged at the other end by locking means generally designated by the reference numeral 50 and disposed in the enclosure 49. The locking means 50 includes a locking member 50*a* shown in FIG. 46 as abutting against the other end of the movable contact member 21 by means of the action of a spring 50*b*. Thus the locking means 50 detachably locks the movable contact member 21 in its closed position.

In its closed position the other end of the movable contact member 21 is slightly inserted into closure driving means generally designated by the reference numeral 60. More specifically, the closure driving means 60 includes a cylinder 60*a* having an open end and a spring loaded piston 60*b* slidably fitted into the cylinder 60*a*. The closure driving means 60 is normally in its energized state by a lifting member (not shown) and the free end of the movable contact member 21 in its closed position is located within the cylinder 60*a* adjacent to the open end.

Figure 47:
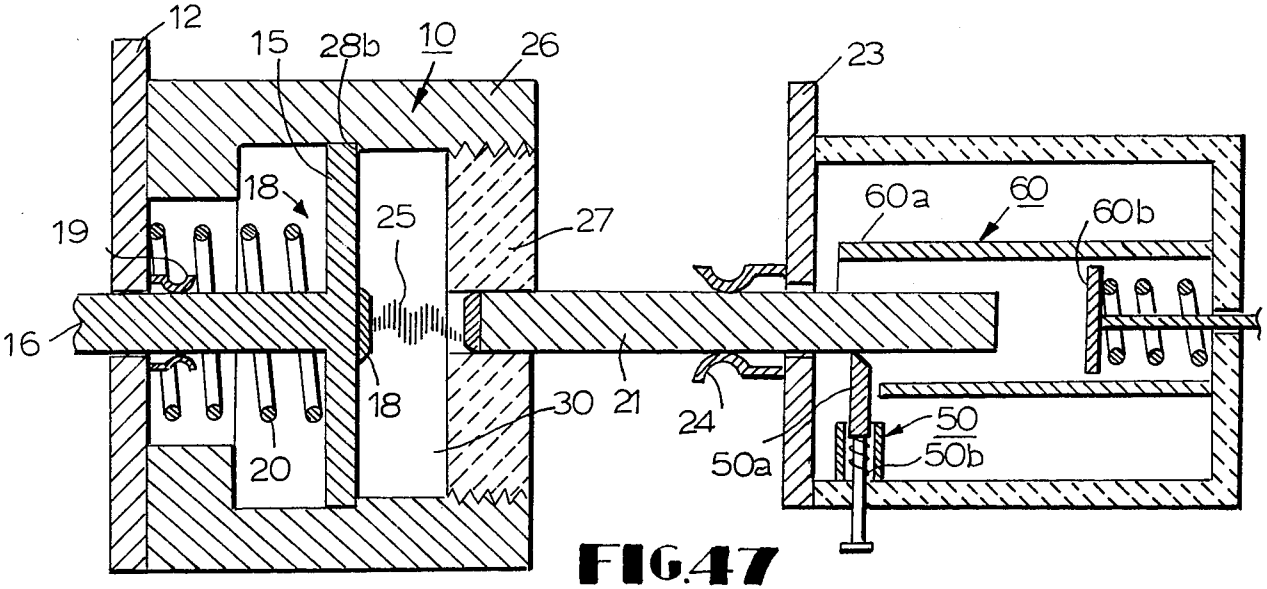
FIGS. 47 and 48 are views similar to FIG. 46 but illustrating the arrangement of FIG. 46 in its tripped and open positions respectively.
Figure 48:
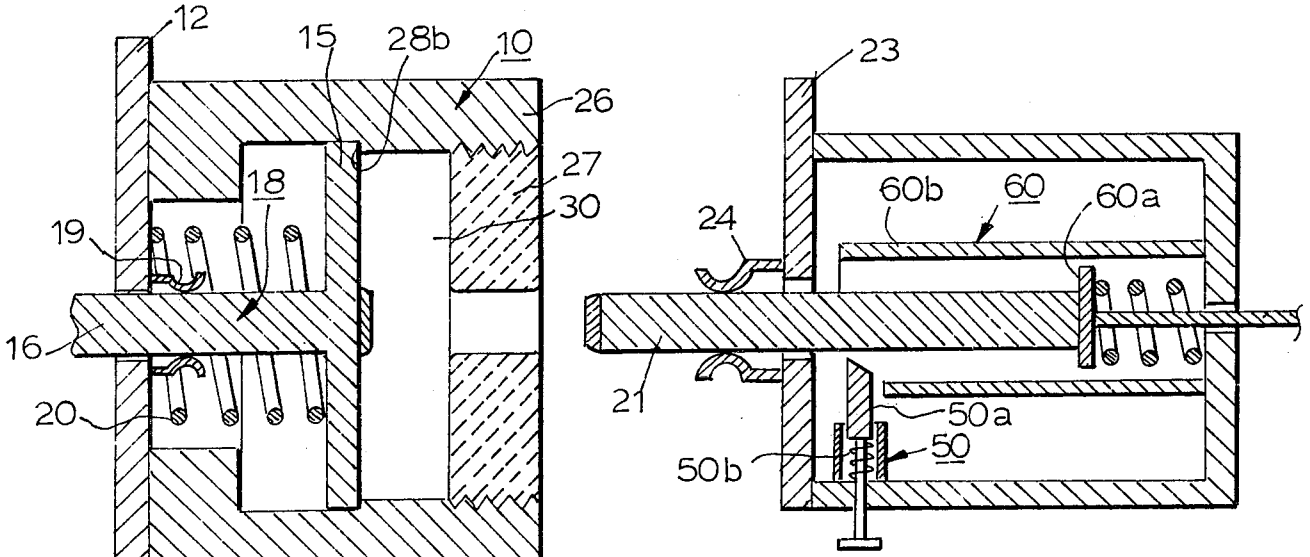

With the movable contact member 21 engaged by the stationary contact member 21, the locking member 50*a* is pulled downward as viewed in FIG. 46 against the action of the spring 50*b*. Therefore the helical spring 20 is operated to move the stationary contact member rightward as viewed in FIG. 46 and the movable contact member 21 strikes an electric arc 25 across contact members 18 and 21 in the manner as described above in conjunction with FIG. 3, 4, 5 and 6 as shown in FIG. 47. Then the electric arc 25 is extinguished as also described above. At that time, the movable contact member 21 has the free end spaced from the nozzle 27 and the other end abutting the piston 60*b* as shown in FIG. 48.

Under these circumstances, the closure driving means 60 discharges its energy in response to a closure command signal. This results in both contact members engaging each other in the manner as described above in conjunction with FIGS. 3 and 4. At that time the movable contact member 21 engages the locking means 50 so as to be locked in its closed position resulting in the completion of the closing operation. Also the closure driving means 60 is put in its energized state by the lifting member (not shown). Therefore the moved components are returned to their original positions shown in FIG. 46.

Since the closure driving means is required only to perform the closing operation, it can be constructed simply and inexpensively. Also, the contact members are maintained in engagement with each other under a pressure by means of the action of the spring so that the contact members can carry a high current. Further, in the interrupting operation, both contact members are separated from each other only after they have reached predetermined positions resulting in the stabilized interrupting performance. If the movable contact member has a large inertia then the same performs the separating operation stably. This results in a more reliable interruption.

Figure 49:
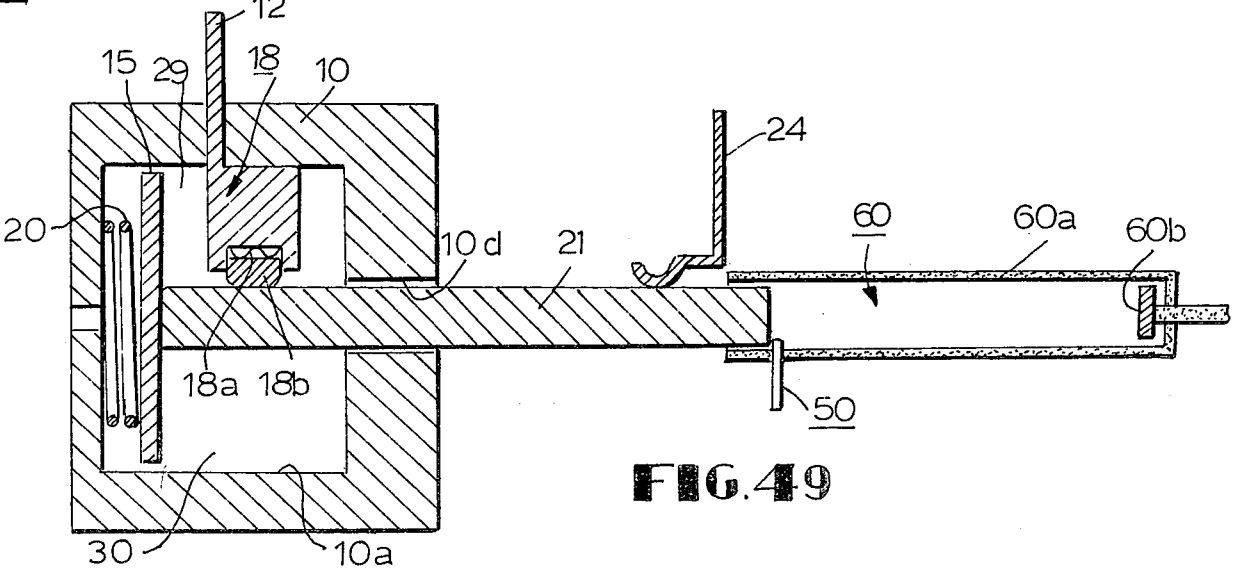
FIG. 49 is a view similar to FIG. 46 but illustrating its closed position a modification of the arrangement shown in FIGS. 46, 47 and 48.

In the arrangement illustrated in FIG. 49 a hollow cylindrical stationary member 10 formed of an electrically insulating material has one end surface, in this case the lefthand end surface as viewed in FIG. 49, provided with a central small hole, an inner cylindrical space 10*a* having a large cross sectional area, and the other or righthand end surface provided with a central hole 10*b* having a small cross sectional area. This hole 10*b* is so dimensioned that the movable contact member 21 movably extends therethrough with a small space formed therearound.

The puffer piston 15 or a slider is slidably fitted in the inner space 10*a* and tends to be moved toward the righthand end surface by means of the action of the helical spring 20 disposed between the lefthand end surface and the piston 15.

The terminal plate 12 is extended through and sealed in the peripheral wall of the hollow member 10 perpendicular to the longitudinal axis of the hollow member 10. The terminal plate 12 defines a boundary between the compression chamber 29 and the reservoir 30 and forms one part of the stationary contact member 18 fixedly secured to the inner peripheral wall surface of the reservoir. The stationary contact member 18 includes a leaf spring 18*a* disposed in a recess disposed on the radially inner surface thereof and a contact 18*b* fitted into the recess and on the leaf spring 18*a*. Therefore the contact 18*b* slidably engages the movable contact member 18 in its closed position by means of the action of the leaf spring 18*a*. In its closed position the movable contact member 18 has one end, in this case the lefthand end as viewed FIG. 49, engaging the puffer piston 15 and the other or righthand end extending somewhat into the cylinder 60*a* of the closure driving means 60 and engaging the locking means 60 movably protruding beyond the peripheral wall of the cylinder 60*a*. The locking means 50 serves to lock the stationary contact member 18 in its closed position. The closure driving means 60 further includes a piston 60*b* slidably fitted into the cylinder 60*a*.

As shown in FIG. 49 a collector 24 is located adjacent to the open end of the cylinder 60*a* and abuts the movable contact member 21.

Figure 50:
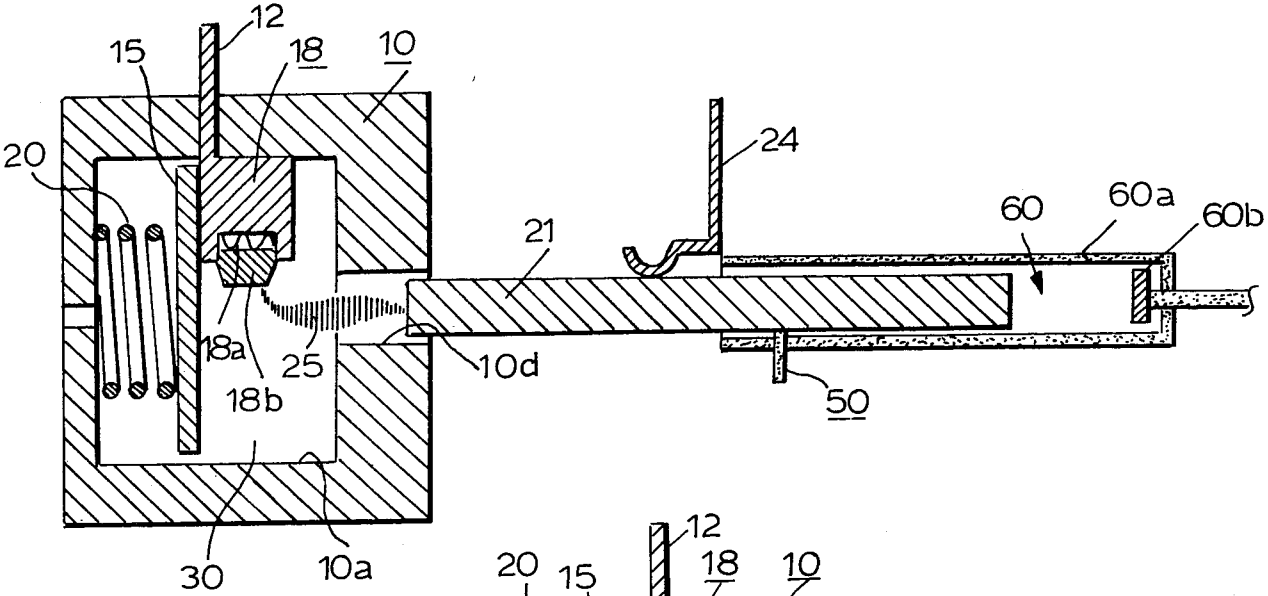
FIGS. 50 and 51 are views similar to FIG. 49 but illustrating the arrangement of FIG. 49 in its tripped and open positions respectively.
Figure 51:
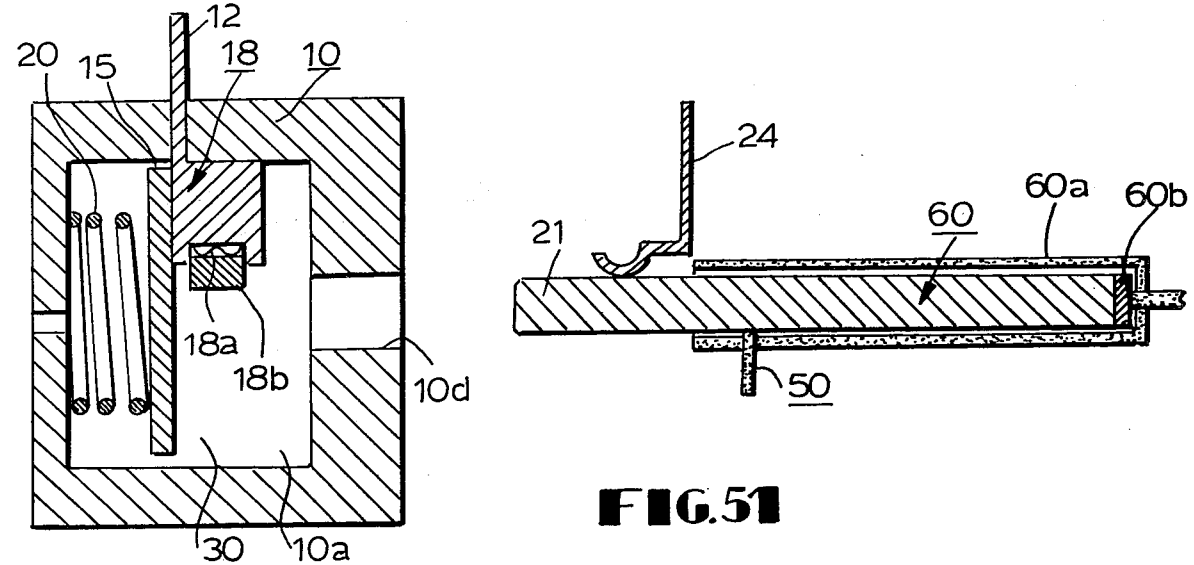

When the locking means 50 is retracted as shown in FIG. 50, the helical spring 20 is operated to move the piston 15 in the rightward direction as viewed in FIG. 49 with the movable contact member 21 to compress the arc-extinguishing fluid in the compression chamber 29 and the reservoir 30 until the piston 15 abuts the terminal plate 12 so as to be prevented from moving further (see FIG. 50). Thereafter the movable contact member 21 continues to be moved in the rightward direction due to its inertia. Then the movable contact member 21 is separated from the stationary contact member 18 to strike an electric arc 25 thereacross as shown in FIG. 50. The electric arc 25 is extinguished as described above and the righthand end of the movable contact member 21 abuts the piston 60*b* of the closure driving means 60 as shown in FIG. 51.

In the closing operation, the piston 60*b* is moved in the leftward direction manually or with a mechanical force resulting, for example, from a spring (not shown) to move the movable contact member 21 in the leftward direction. The movable contact member 21 engages the stationary contact member 18 and then abuts the piston 15 thereby to receive the puffer action from the helical spring 20 while the latter accumulates energy. When the helical spring 20 is compressed to accumulate energy, the locking means 50 engages the righthand end of the movable contact member 21 to lock the contact member 21 in its closed position. Then the piston 60*b* is returned to its original position whereupon the closing operation is completed. That is, the moved components are returned to their positions shown in FIG. 49.

From the foregoing it is seen that by providing the piston or slider and a resilient member or the helical spring for pushing the slider, a simple closure driving means can be incorporated into a simple, inexpensive switch to improve its interrupting performance.

While the present invention has been illustrated and described in conjunction with several preferred embodiments thereof it is to be understood that numerous changes and modifications may be resorted to without departing from the spirit and scope of the present invention.

What we claim is:

1. A gas blast type circuit interrupter, comprising:

a hollow cylindrical member adapted to be disposed within a space having an arc-extinguishing gas therein, said member having a first end and a second end, said second end having a central opening therein;

a cylindrical piston slidably disposed within said hollow cylindrical member for translational movement along the axis of said hollow cylindrical member between a first extreme position toward said first end and a second extreme position toward said second end, said second extreme position being at a predetermined distance from said second end, said piston and said second end thereby defining a variable volume chamber within said hollow cylindrical member, said chamber being in gas communication with said space and accomodating a portion of said arc-extinguishing gas;

stop means disposed on the inside surface of said hollow cylindrical member for stopping said piston at said predetermined distance from said second end;

a first contact member having a portion fixedly disposed at one end of said cylindrical member and having a movable contact in a portion of said chamber, said cylindrical piston being movable with said contact of said first contact member;

a second contact member disposed in said housing for translational movement along the axis of said hollow cylindrical member between a first extreme location in said variable chamber and a second extreme location outside said chamber, said second contact member in said first extreme location having one end thereof engaging with the contact of said first contact member for forming an electrical circuit therewith and engaging said piston for holding said piston in said first extreme position, and said second contact member extending out of said chamber through said opening in said second end, and said second member having said one end disengaged from said first contact member and said piston in said second extreme location;

said second contact member being movable from said first location to said second location for interrupting a circuit and thereby striking an electric arc across said contact members; and piston moving means responsive to the movement of said second contact from said first to said second locations for moving said piston from said first to said second position, whereby said portion of arc-extinguishing gas compressed by the movement of the piston and the temperature of which is raised by said arc is blown at the arc through said opening when said one end of said second contact member is moved outside of said chamber.

2. A circuit interrupter as claimed in claim 1 wherein said contact is integral with said piston and said first contact further has a fixed portion on said housing and a slidable connection between said piston and the fixedly disposed portion of said first contact member.

3. A circuit interrupter as claimed in claim 1 wherein said piston moving means is a resilient member for urging said piston in a direction from said first to said second extreme position and wherein said second contact member engages said contact and holds said piston at said first extreme position against the force of said resilient member when said second contact member is in said first extreme location.

4. A circuit interrupter as claimed in claim 1 wherein at least one of said first and second contact members has a fluid passageway therein for placing the exterior of said hollow cylindrical member and said variable volume chamber in communication.

5. A circuit interrupter as claimed in claim 4 wherein said fluid passageway opens in the contact surface of said contact member.

6. A circuit interrupter as claimed in claim 4 further comprising an encircling member encircling the contact along a predetermined length extending in the direction of movement of said second contact member.

7. A circuit interrupter as claimed in claim 4 wherein said fluid passageway includes a hole, and which upon the movement of said contact, is uncovered and covered for connecting and disconnecting said fluid passageway to and from the exterior of said hollow cylindrical member.

8. A circuit interrupter as claimed in claim 7 wherein said fluid passageway extends through a movable contact of said first contact member and includes a plurality of holes, which upon movement of said contact, are uncovered and covered for selectively connecting and disconnecting said fluid passageway to and from the exterior of said hollow cylindrical member.

9. A circuit interrupter as claimed in claim 1 further comprising an encircling member encircling said contact along a predetermined length extending in the direction of movement of said second contact member.

10. A circuit interrupter as claimed in claim 1 further comprising a resilient member for urging said piston in a direction toward said second extreme position, closing means for moving said second contact member toward said first contact member for bringing both contact members into engaging relationship, and locking means for holding said second contact member in the engaged position.

11. A circuit interrupter as claimed in claim 1 further comprising releasable coupling means connected between said contact members and releasable only at tripping force in excess of a predetermined magnitude.

12. A circuit interrupter as claimed in claim 11 further comprising means for returning said piston to the first extreme position after said releasable coupling means is released.

13. A circuit interrupter as claimed in claim 11 wherein said returning means is a resilient member.

14. A circuit interrupter as claimed in claim 1 wherein said piston has an arc contact member thereon for engaging and disengaging from said second contact member and further comprising an encircling member encircling said arc contact member for a predetermined length extending in the direction of movement of said second contact member.

15. A circuit interrupter as claimed in claim 1 further comprising an engaging means for engaging said piston at the second extreme position and releasably holding said piston.

16. A circuit interrupter as claimed in claim 15 wherein said engaging means is connected between the outer peripheral surface of said piston and the inner peripheral surface of said variable volume chamber.

17. A circuit interrupter as claimed in claim 1 wherein said hollow cylindrical member has a pressure chamber therein on the opposite side of said piston from said variable volume chamber and said hollow cylindrical member having an opening for placing said back pressure chamber in communication with said space, and a check valve in said opening for permitting the arc-extinguishing fluid to flow only into said back pressure chamber from the exterior of said hollow cylindrical member.

18. A circuit interrupter as claimed in claim 1 wherein said stop means comprises a stop in the interior of said hollow cylindrical member against which said piston abuts at said second extreme position.

19. A circuit interrupter as claimed in claim 1 wherein said central opening is a flared nozzle diverging toward the exterior of said hollow cylindrical member.

20. A gas blast type circuit interrupter, comprising:

a hollow cylindrical member adapted to be disposed within a space having an arc-extinguishing gas therein, said member having a first end and a second end, said second end having a central opening therein;

a hollow cylindrical member adapted to be disposed within a space having an arc-extinguishing gas therein, said member having a first end and a second end, said second end having a central opening therein;

a cylindrical piston slidably disposed within said hollow cylindrical member for translational movement along the axis of said hollow cylindrical member between a first extreme position toward said first end and a second extreme position toward said second end, said second extreme position being at a predetermined distance from said second end, said piston and said second end thereby defining a variable volume chamber within said hollow cylindrical member, said chamber being in gas communication with said space and accommodating a portion of said arc-extinguishing gas;

stop means disposed on the inside surface of said hollow cylindrical member for stopping said piston at said predetermined distance from said second end;

a first contact member fixedly disposed in said cylindrical member, said cylindrical piston being movable independently of said first contact member;

a second contact member disposed in said housing for translational movement along the axis of said hollow cylindrical member between a first extreme location in said variable chamber and a second extreme location outside said chamber, said second contact member in said first extreme location engaging with said first contact member for forming an electrical circuit therewith and engaging said piston for holding said piston in said first extreme position, and said second contact member extending out of said chamber through said opening in said second end, and said second member having said one end disengaged from said first contact member and said piston in said second extreme location;

said second contact member being movable from said first location to said second location for interrupting a circuit and thereby striking an electric arc across said contact members; and piston moving means responsive to the movement of said second contact from said first to said second locations for moving said piston from said first to said second position, whereby said portion of arc-extinguishing gas compressed by the movement of the piston and the temperature of which is raised by said arc is blown at the arc through said opening when said one end of said second contact member is moved outside of said chamber.

21. A circuit interrupter as claimed in claim 20 wherein said piston moving means is a resilient member for urging said piston in a direction from said first to said second extreme position and wherein said second contact member engages said contact and holds said piston at said first extreme position against the force of said resilient member when said second contact member is in said first extreme location.

22. A circuit interrupter as claimed in claim 20 further comprising a resilient member for urging said piston in a direction toward said second extreme position, closing means for moving said second contact member toward said first contact member for bringing both contact members into engaging relationship, and locking means for holding said second contact member in the engaged position.

23. A circuit interrupter as claimed in claim 18 wherein said stationary contact member slidably engages the outer peripheral surface of said movable contact member.

24. A circuit interrupter as claimed in claim 18 wherein said stationary contact member extends laterally into said variable volume chamber.

* * * * *